US009394071B2

(12) United States Patent
Yamasita et al.

(10) Patent No.: US 9,394,071 B2
(45) Date of Patent: Jul. 19, 2016

(54) LABEL AFFIXING DEVICE AND METHOD OF AFFIXING LABEL

(75) Inventors: Kousaku Yamasita, Tokyo (JP); Keiji Ishigami, Tokyo (JP)

(73) Assignee: TERAOKA SEIKO CO., LTD., Tokyo (JP)

( * ) Notice: Subject to any disclaimer, the term of this patent is extended or adjusted under 35 U.S.C. 154(b) by 124 days.

(21) Appl. No.: 13/352,678

(22) Filed: Jan. 18, 2012

(65) Prior Publication Data

US 2012/0193022 A1 Aug. 2, 2012

(30) Foreign Application Priority Data

Jan. 27, 2011 (JP) ..... 2011-15789
Mar. 10, 2011 (JP) ..... 2011-53343

(51) Int. Cl.

| | |
|---|---|
| ***B65C 1/02*** | (2006.01) |
| ***B65C 9/18*** | (2006.01) |
| ***B65C 9/36*** | (2006.01) |
| ***B65C 9/42*** | (2006.01) |
| ***B32B 38/04*** | (2006.01) |

(52) U.S. Cl.

CPC ..... *B65C 1/021* (2013.01); *B65C 9/1826* (2013.01); *B65C 9/36* (2013.01); *B65C 9/42* (2013.01)

(58) Field of Classification Search

CPC ..... B65C 1/021; B65C 9/26; B65C 9/36; B65C 9/42; B65C 9/1826; B32B 38/00; B32B 38/04; B32B 2038/04; B32B 2038/045

USPC ..... 156/250, 252, 253, 256, 510, 516, 517

See application file for complete search history.

(56) References Cited

U.S. PATENT DOCUMENTS

| | | | | |
|---|---|---|---|---|
| 4,784,714 | A | 11/1988 | Shibata | |
| 6,615,106 | B2 * | 9/2003 | Soto et al. | 700/235 |
| 7,313,894 | B2 | 1/2008 | Mise et al. | |
| 2004/0112520 | A1 | 6/2004 | Hanschen et al. | |
| 2005/0139323 | A1 | 6/2005 | Syde et al. | |

(Continued)

FOREIGN PATENT DOCUMENTS

| | | |
|---|---|---|
| EP | 1571092 | 9/2005 |
| JP | 51-24898 | 2/1976 |

(Continued)

OTHER PUBLICATIONS

Japan Office action, dated Feb. 24, 2015 along with an English translation thereof.
E.P.O. Office action, mail date is Jun. 3, 2015.
Japan Office action, dated Dec. 16, 2014 along with an English translation thereof.

(Continued)

*Primary Examiner* — Mark A Osele
*Assistant Examiner* — Christopher C Caillouet
(74) *Attorney, Agent, or Firm* — Greenblum & Bernstein, P.L.C.

(57) ABSTRACT

Provided is a label affixing device to affix linerless labels having different lengths cut and dispensed at the correct position on an article. A label affixing device includes a label issuing unit for cutting and dispensing a linerless label sheet into an individual label, and a label affixer for affixing to an article the linerless label dispensed; the label issuing unit includes a label feeder that feeds the linerless label sheet, a label cutter that cuts the linerless label sheet, and a label cutter controller that controls the operation of the label cutter; and the label affixer includes an affixing unit that moves the linerless label towards an article, and an affixing unit controller that controls the movement of the affixing unit.

2 Claims, 22 Drawing Sheets

(56) References Cited

U.S. PATENT DOCUMENTS

| | | | | |
|---|---|---|---|---|
| 2005/0193684 | A1 | 9/2005 | Mise et al. | |
| 2012/0193022 | A1 * | 8/2012 | Yamasita et al. | 156/249 |

FOREIGN PATENT DOCUMENTS

| | | |
|---|---|---|
| JP | 7068853 | 3/1995 |
| JP | 9-77034 | 3/1997 |
| JP | 2001-097332 | 4/2001 |
| JP | 2002-337826 | 11/2002 |
| JP | 2004-51132 | 2/2004 |
| JP | 2005-193926 | 7/2005 |

OTHER PUBLICATIONS

Office Action issued in Japan Counterpart Patent Appl. No. 2011-015789, dated Nov. 4, 2015 , along with an English translation thereof.

Decision to Grant a Patent in Japan Counterpart Patent Appl. No. 2011-053343, dated Aug. 18, 2015 , along with an English translation thereof.

Decision to Grant issued in EP Patent Appl. No. 12152125.6, dated Jan. 4, 2016.

EPO Extended Search Report dated May 13, 2013 with English language translation.

* cited by examiner

FIG.4

Commodity file

| Commodity code | Commodity name | Price | Barcode | Additives | Label format | Tray format |
|---|---|---|---|---|---|---|
| 0001 | Miso marinated pork | 700 | | Antioxidant | 1 | 1 |
| 0002 | ⋮ | ⋮ | ⋮ | ⋮ | ⋮ | ⋮ |
| ⋮ | | | | | | |

FIG.5

Label format file

| Label format number | Commodity name | | | | Additives | | | | ... | Label length |
|---|---|---|---|---|---|---|---|---|---|---|
| | Position | Height | Length | Font | Position | Height | Length | Font | | |
| #1 | ... | | | | | | | | ... | ... |
| #2 | ... | | | | | | | | ... | ... |
| ... | | | | | | | | | | |

FIG.6

Tray file

| Tray No. | Width | Depth | Height | Packaging (g) | XO | YO | Movement | Timing | 90-degree rotation | 180-degree rotation | ... |
|---|---|---|---|---|---|---|---|---|---|---|---|
| 1 | 200 | 100 | 30 | 1 | 10 | 10 | X | T | 1 | 0 | ... |
| 2 | ⋮ | ⋮ | ⋮ | ⋮ | ⋮ | ⋮ | ⋮ | ⋮ | ⋮ | ⋮ | ⋮ |
| ⋮ | | | | | | | | | | | |

Tray transporting direction

Tray transporting direction

Tray transporting direction

FIG.14A

Print label

Tempura combo platter (8 items)

900 yen

Contains wheat

Wheat, eggs, misc., aspartame, red color-3

White plant coloring, soy sauce, table salt, rosewood coloring

XYZ Supermarket 03-0000-0000

FIG.14B

Print label

Tempura combo platter (15 items)

1280 yen

Contains wheat

Wheat, eggs, misc., aspartame, red color-3

White plant coloring, soy sauce, table salt, rosewood coloring

White ceramic, shellac, nitric acid K, gellan

Bread flour, goby fish oil, fermentation regulator, coloring, vegetable coloring Yellow-5, xanthan gum, cabbage, fish, beef, pickles XYZ Supermarket 03-0000-0000

LABEL AFFIXING DEVICE AND METHOD OF AFFIXING LABEL

FIELD OF THE INVENTION

The present invention relates to a label affixing device and a method of affixing a label whereby a linerless label sheet spooled out from a linerless label roll has prescribed particulars printed thereon, is cut into an individual linerless label of a prescribed length, dispensed, and affixed to an article by a label affixer.

BACKGROUND OF THE INVENTION

A label printer that prints prescribed particulars on a label without a liner, or what is called a linerless label sheet having one surface which is a print surface and the other surface which is an affixing surface possessing an adhesive layer, cuts the label sheet according to the amount of characters printed thereon and dispenses an individual linerless label is known.

Further, where a normal elongated strip shaped label roll is composed of a liner whereon label sheets are temporarily adhered so as to be releasable form the roll at a uniform distance apart, a label affixing device that uses said roll in printing and dispensing labels, and affixing the printed and dispensed label to an article (for example, a packaged commodity packaged in stretch film (stretchable plastic film)) is also known.

When labels are printed and dispensed by the aforementioned label affixing device, given that the label lengths (the length along the longitudinal direction of the liner) are all the same for each label temporarily adhered to a single liner label roll, the label lengths for the labels printed with the prescribed particulars and dispensed are all the same. Accordingly, if there is a predetermined position for affixing the label (for example, at the bottom right of a commodity), the movement of the label affixing device can be controlled so that the label is affixed at the predetermined position.

However, in the case of the aforementioned linerless label, each label is not of predetermined length and a label affixing device cuts the linerless label sheet in relation to the amount of data printed (that is, the amount of printed information) on the linerless label sheet to form an individual label (a single label). Therefore, for labels cut and dispensed from the same linerless label roll, the label length for each dispensed label will differ. In addition, if an ordinary liner label affixing technology for affixing a label to an article is used to affix linerless labels having differing label lengths, for the ordinary liner label, the conditions for affixing the labels are constant because the labels temporarily adhered to a single label roll have all the same length, and therefore as illustrated previously, partway through the label roll, for instance if the label length becomes longer or shorter, there is the case that the label is not affixed at the proper position on the article to be labeled. Specifically, there are problems such as, the label is affixed jutting out from the labeled article, or the amount of blank space from between a prescribed location (for example, the bottom right corner of the labeled article) and the affixed position is not constant, and so forth.

In addition, when products with labels affixed in a non-uniform manner are placed on a store shelf, the overall appearance is visually unappealing, and the desire of the consumer to buy the product may be lowered as result.

A conventional linerless label affixing device using a linerless label roll pulls out a linerless label sheet from the linerless label roll, uses an auto-cutter (label cutter) to cut the linerless label sheet into an individual linerless label of a prescribed length, and thereafter holds the linerless label sheet with a holder provided in front of label dispensing outlet. A label affixer receives the linerless label held by the holder and subsequently affixes the linerless label to the outer surface of an article to be labeled (a packaged good).

Nevertheless, there are cases where the label cannot be held at the prescribed holding position. For example, the label affixing device shown in FIG. 22 pulls out a label sheet 82 from a linerless label roll, auto-cutter 81 (generally comprised of a fixed blade and an up and down movable blade) cuts the label sheet into a prescribed length forming thereby an individual linerless label L. At this point in time, because of the force of the cut of the cutter (the movable blade) and the reaction when the movable blade separates (that is, the rebound when the end part of the label warped by the cutting action of the movable blade tries to return to its original position) the cut linerless label L flies towards the dispensing direction (the feeding direction) (see FIG. 22(*a*)) and thus cannot be held at the prescribed holding position. Consequently, the label is affixed to the article to be labeled in the aforementioned dislocated fashion, or in a tilting manner, the label juts out from the labeled article, or possibly the amount of blank space between a prescribed location (for example, the bottom right corner of the labeled article) and the affixed position is not constant, and so forth, and there is a lack of uniformity between the affixed position and the position setting for the label.

The label sheet 82 of the linerless label roll is comprised of a printing surface on one side and an affixing surface on the side opposite thereto on which there is an adhesive layer; for this reason, when the auto-cutter 81 cuts the label sheet 82 the paste on the adhesive layer sticks to the auto cutter 81 and so forth, leading to the linerless label L to skew (rotate horizontally) with respect to a given location (with a given location as the fulcrum). (See FIG. 22(*b*)). As a result the cut linerless label L will remain in a skewed position on top of the holder 83 and if the skewed label is affixed to the article to be labeled as is, this will result in the label jutting out from the labeled article, or possibly will result in the amount of blank space between a prescribed location (for example, the bottom right corner of the labeled article) and the affixed position on the article not being constant, and so forth, and thus there is a lack of uniformity between the affixed position and the position setting for the label.

Additionally, there are cases where labels with a length and width smaller than the standard sized linerless label which is of length 40 mm by width 60 mm (where the aforementioned length is the feeding direction of the label) are used. A holder holds the linerless label on the sides of both end parts in the width direction orthogonal to the feeding direction of the cut linerless label and in the above mentioned cases, the holding position of the holder must be adjusted to accommodate the width for a label with a smaller length and width. However, if the holding position of the holder is not adjusted, the holder may not be able to hold the cut and dispensed linerless label and consequently the label affixer cannot affix the linerless label to the article to be labeled because the holder is not holding the received label.

SUMMARY OF THE INVENTION

The present invention, devised to overcome the problems and disadvantages found in the related art, provides a label affixing device whereby it is possible to affix linerless labels of different lengths cut and dispensed from a linerless label roll at the correct position on an article to be labeled.

A label affixing device according to an embodiment of the present invention may comprise:

a label issuing unit for pulling off a label sheet from a linerless label roll having one surface which is a print surface and another surface which is an affixing surface possessing an adhesive layer, cutting the label sheet into an individual label of prescribed length, and dispensing the label, and a label affixer for affixing to an article the linerless label dispensed by the label issuing unit;

the label issuing unit may include:

a label feeder that feeds the linerless label sheet of a prescribed length from the linerless label roll, a label cutter that cuts a segment of prescribed length of the linerless label being fed by the label feeder at the end portion at the upstream of the feeding direction of the linerless label sheet, and a label cutter controller that controls the operation of the label cutter;

and the label affixer may include:

an affixing unit that suctions up and holds the linerless label dispensed from the label issuing unit, and that moves oriented towards an article to be labeled, and an affixing unit controller that controls the affixing unit and the movement thereof;

the movement of the label affixer and/or the timing at which the label cutter is operated is controlled in relation to the label length in the feeding direction of the linerless label dispensed from the label issuing unit.

According to another embodiment of the present invention, the affixing unit controller of the label affixing device may control the movement of the affixing unit in relation to the label length in the label printing direction of the linerless label dispensed from the label issuing unit, and may control the affixing unit to affix the linerless label to the article to be labeled.

According to the above mentioned label affixing device, because the affixing unit is controlled in relation to the label length of the linerless label printed on and dispensed from the label issuing unit which uses a linerless label roll, even if the label lengths are different lengths, the movement of the affixing unit is controlled (corrected) in relation to the length of the dispensed linerless label, therefore regardless of whether or not the label length is long or short, the affixing unit will affix the linerless label at the correct affixing position on the article to be labeled.

According to another embodiment of the present invention the label affixing device may also include a label length detector that determines the length of the linerless label dispensed from the label issuing unit; an affixing position information storage that stores an affixing position information used to affix a dispensed linerless label; a reader that reads out the affixing position information stored in the affixing position information storage; whereby the affixing unit controller controls the movement of the affixing unit such that the affixing unit affixes the dispensed label to a position indicated in the affixing position information readout by the reader on the basis of the label length determined by the label length detector. In other words, even if the label length is long or short, the movement of the affixing unit is controlled so that the affixing unit moves to the position indicated in the affixing position information retrieved by the data retriever, and thus the label is reliably affixed at the position indicated in the position affixing information.

A label affixing device according to any embodiment of the present invention may be combined with a packaging machine having a function of packaged goods with a film, thereby linking from the packaging to the label affixing functions and providing an automatic packaging and pricing machine. As a specific example, a packaging machine that transports an article to be packaged to a prescribed position may be comprised of a packaging unit that packages the transported article with a film, and a timer comparator that determines a printing and affixing time which is the time taken from the label issuing unit commences printing on the linerless label and the printed and dispensed linerless label is affixed to the article to be labeled, and a package ejection time which is the time taken from the packaging machine commences transporting the article to be packaged and the packaged article is conveyed to the position at which the affixing unit will affix a label thereto, and performs a comparison of the printing and affixing time and the package ejection time; whereby, the packaging machine is controlled to increase the package ejection time by at least the difference between the printing and affixing time and the package ejection time if it is determined by the timer comparator that the printing and affixing time is longer than the package ejection time.

Further, the present invention provides a device and a method of affixing a label whereby an individual linerless label of prescribed length cut from the linerless label sheet is unaffected at the time of cutting, and the label affixer holds the post-cut linerless label in the correct position and thereby affixes the linerless label in the correct orientation and at the correct position on the article to be labeled.

Specifically, in a label affixing device according to an embodiment of the present invention, a label cutter controller controls the label cutter to operate around the time the label affixer receives a linerless label transported from the label issuing unit. Namely, the label affixing device according to an embodiment of the present invention may further comprise a holder that temporarily holds the individual linerless label cut by and transported from the label cutter; and a detector that detects whether the label affixer is positioned at a receiving position directly above the holder; wherein the label cutter controller on the basis of the results from the detector selects the time at which to control the label cutter to operate from any of: the time the affixing unit of the label affixer comes in proximity to the dispensed linerless label, or the time the affixing unit of the label affixer suctions the dispensed linerless label, or the time after the affixing unit of the label affixer suctions the dispensed linerless label.

Thereby, because the timing for operating the label cutter is established on the basis of the descent time needed in order for the label affixer (the affixing unit) to suction the linerless label held by the holder, and the label length of the cut and dispensed linerless label, the affixing unit in the label affixer can suction and hold the linerless label at the correct position and affix the linerless label in the correct orientation at the correct prescribed position on the article to be labeled.

Further, a method for affixing a label according to an embodiment of the present invention may comprise steps of pulling out a label sheet from a linerless label roll having one surface which is a print surface and the other surface which is an affixing surface possessing an adhesive layer, controlling a label cutter to cut the label sheet into an individual label of prescribed length, controlling a label affixer to hold the cut linerless label and to affix the same to an article, wherein the label cutter that pulls off a label sheet from a linerless label roll and cuts the label sheet into an individual label of prescribed length is controlled to operate at any of: the time the affixing unit of the label affixer comes in proximity to the dispensed linerless label, or the time the affixing unit of the label affixer holds the dispensed linerless label, or after the affixing unit of the label affixer holds the dispensed linerless label.

BRIEF DESCRIPTION OF THE DRAWINGS

FIG. 1(*b*) is a schematic view showing the label issuing mechanism in a label affixing device according to an embodiment.

FIG. 4 is an explanatory diagram showing an outline of a commodity file.

FIG. 5 is an explanatory diagram showing an outline of a label format file.

FIG. 6 is an explanatory diagram showing an outline of a tray file.

FIG. 7 (*b*) is an explanatory diagram showing the positional relationship in the horizontal direction between the standby position for a label suction unit and a label dispensing outlet; FIG. 7 (*c*) is an explanatory diagram showing the positional relationship in the orthogonal direction between the standby position for a label suction unit and a label dispensing outlet.

FIG. 8 (*b*) shows the state of an affixed label when the affixing unit affixes a label shorter than the standard label length; and FIG. 8 (*c*) shows the state of an affixed label when the label is shorter than the standard label length, and the affixing unit adjusts its movements and affixes the label.

FIG. 9 (*b*) shows the state of an affixed label when the affixing unit affixes a label shorter than the standard label length; and FIG. 9 (*c*) shows the state of an affixed label when the label is shorter than the standard label length, and the affixing unit adjusts its movements and affixes the label.

FIG. 14 is a schematic drawing of the fluctuations in label length resulting from the fluctuations in the amount of data for print items.

FIG. 17 (*b*) is a front view showing the label cutter of a label issuing unit according to an embodiment of the present invention.

FIG. 18 (*b*) is a longitudinal side view showing the holder of a label issuing unit according to an embodiment of the present invention.

DESCRIPTIONS OF THE INVENTION

Below, one example of an embodiment of the present invention, that is, a weighing pricing and packaging device with a label affixing device combined therewith is explained with reference to the drawings.

First Embodiment

Figure 1A:
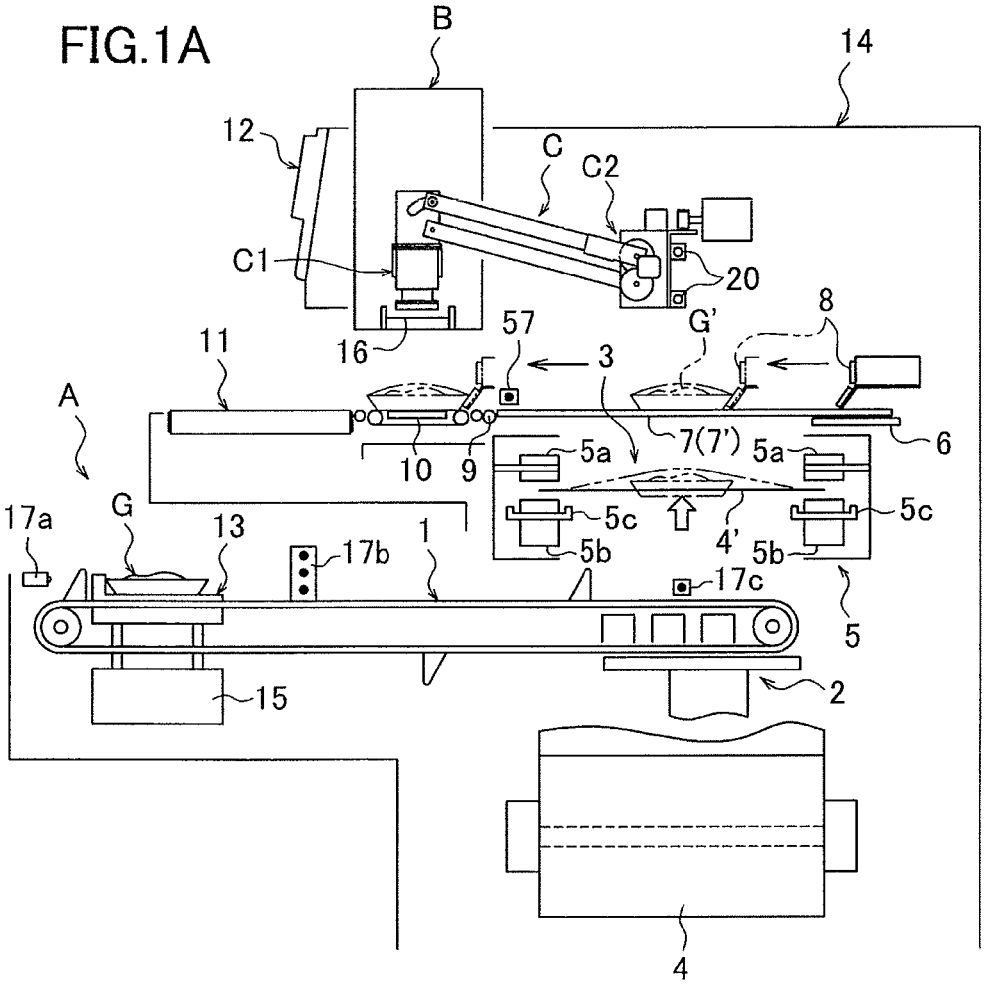
FIG. 1(*a*) is a longitudinal side view showing a label affixing device according to an embodiment of the present invention installed in a packaging machine.
Figure 1B:
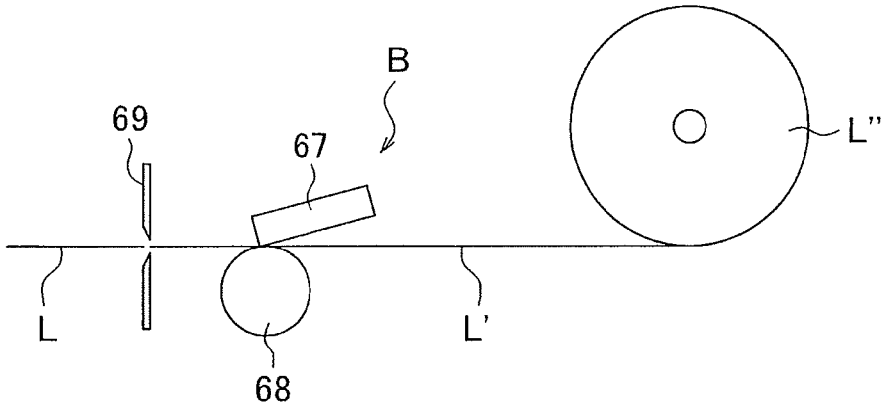

FIG. 1(*a*) is a schematic view showing an entire weighing pricing and packaging device; A is a stretch film packaging machine, B is a linerless label issuing unit (weight label printer) that prints prescribed particulars onto a linerless label sheet, and cuts the linerless label sheet into an individual linerless label; C is a label affixer that suctions and holds a linerless label dispensed from the label issuing unit B and affixes the linerless label to a packaged good (the article to be labeled) G'. Within the stretch film packaging machine A, the label issuing unit B is arranged laterally at the region above an ejection path 10 (heat seal unit) of the packaged good G' and the label affixer C is arranged at the region above the ejection path.

Arranged frontward of the machine frame 14 of the stretch film packaging machine A is a commodity stage 13 which holds goods to be packaged G thereupon; and a push conveyor 1 conveys the goods to be packaged G placed on the commodity stage 13 towards an elevator 2 provided inside the machine frame 14. Further, the following example illustrates the case where the goods to be packaged G are transported while seated in a container, that is, seated in a tray, and further the commodity stage 13 is constructed to function as the weighing tray for the weighing unit. A width detecting sensor 17*a* for measuring the width of the goods to be packaged G is provided in the vicinity just in front of the commodity stage 13.

Moreover, a detecting sensor 17*b* for detecting the height and length (depth) of the goods to be packaged G is provided positioned laterally to the push conveyor 1 along the transporting path of the goods to be packaged G. A plurality of detecting sensors are provided in the top to bottom direction, and the height of the goods to be packaged G can be sensed by determining which detecting sensor 17*b* positioned at a given position detected the goods to be packaged G; additionally, the from the time the detecting sensor 17*b* detects the leading edge of the goods to be packaged G until the time the trailing edge thereof passes the detector can be measured. Given that the driving speed of the push conveyor 1 is constant, the length dimension of the goods to be packaged G (the length along the transporting direction) can be determined using the measured time.

A packaging unit 3 is provided at an upper region of the above mentioned elevator 2 and a plastic film roll 4 is setup in a lateral region (a direction at right angles with the pusher type conveyor of the packaging unit 3), a film 4' is pulled off from the plastic film roll 4 by a film feeder 5, and the film 4', after being cut to a prescribed length is transported to the packaging unit 3. Finally an elevator sensor 17*c* is provided that senses whether or not the goods to be packaged G are sitting on the elevator 2 while the elevator 2 is at its initial position (the lowest position).

The packaging unit 3 is provided with a rearward tucking member 6 that folds the end part of the film 4' covering the top surface of the goods to be packaged G over the sides and under the bottom of the goods to be packaged G; a left-right tucking member 7, 7'; a pusher type ejector 8 that pushes out the already wrapped packaged goods; and forward tucking roller 9. In the packaging unit, the rearward tucking member 6 and the left-right tucking member 7, 7' are arranged above the film feeder 5; the pusher type ejector 8 and the forward tucking roller 9 are arranged above the left-right tucking member 7, 7', wherein the forward tucking roller 9 is positioned in front in the moving direction of the pusher type ejector 8. The pusher type ejector 8 moves from its initial position (the position showed as a solid line) at the right in FIG. 1(*a*) to just in front of the ejection path 10 (heat seal unit), pushing the packaged goods G' out to the ejection path 10 (heat seal unit).

The above mentioned film feeder 5 is provided with top and bottom pairs of endless elastic belts 5*a*, 5*b* that sandwich the film in the width direction at the side end parts, and a clamp plate 5*c* that pressures the lower elastic belt 5*b* into pressing contact with upper elastic belt 5*a*; the top and bottom pairs of endless elastic belts 5*a*, 5*b* are arranged at the front and rear of the goods to be packaged G, sandwiching the goods to be packaged G therebetween.

The ejection path 10 (heat seal unit) is arranged in front of the forward tucking roller 9. The ejection path 10 (heat seal unit) applies heat to and thereby fastens the overlapping of film tucked under the underside surface of the goods being packaged G, and has an ejection means 11 arranged in the front section thereof. A console unit 12 is arranged on the machine frame 14; the label issuing unit (weight label printer) B is arranged laterally in a region above the ejection path 10 (heat seal unit); and the affixing unit C is arranged above the heat seal unit 10.

In the stretch film packaging machine A, the goods to be packaged G transported on the elevator 2 are lifted up by the ascent of the elevator 2 and pushed through the film 4' stretched tightly across the packaging unit 3 and the film 4' thereby covers the top surface of the goods being packaged G. The rearward tucking member 6 and the left-right tucking members 7, 7' then fold and tuck the end portions of the film 4' under the underside surface of the goods being packaged G.

Next, the forward tucking roller 9 folds and tucks the frontward end part of the film 4' under the underside surface of the goods being packaged G while said goods are being pushed horizontally towards the ejection path 10 (heat seal unit); the heat seal unit 10 at the ejection path heat seals the overlapping portions of the film tucked under the underside surface of the goods being packaged G and thereby packaged goods G' is obtained.

The label issuing unit B based on the weight data received from placing the goods to be packaged G on the weighing tray 15 on the commodity stage 13 of the stretch film packaging machine A, calculates the commodity price from a previously input unit price, prints the price and other commodity data to the linerless label sheet, and cuts and dispenses an individual linerless label. A label dispensing outlet (holder) 16 provided in the label issuing unit B, holds the printed and dispensed linerless label L substantially horizontally with the printed side facing up.

Specifically, the label issuing unit B is provided with a linerless label printer, and as shown in the schematic view in FIG. 1(*b*), the label issuing unit B pulls out a linerless label sheet L' from a linerless label sheet roll L" which is a roll of linerless label sheet L' having a thermal color developing surface on the front surface and an adhesive surface on the rear surface, transports the linerless label sheet L' sandwiched between a thermal head 67 and a platen roller 68 driven by a stepping motor 48 (not shown) while applying heat, and thereby prints to the linerless label sheet L'. Then, a cutter (a label cutter) 69 cuts the printed linerless label sheet L', so that the label issuing unit B dispenses an individual linerless label L.

The method for printing to the linerless label sheet L' is not limited to using a thermal head to perform thermal color development; a thermal head and an ink ribbon method may be used for printing.

The label affixer C for affixing a linerless label L held at the label dispensing outlet 16 of the label issuing unit B to the packaged goods G' may be configured from a label suction unit (affixing unit) C1 that suctions a linerless label L held at the label dispensing outlet 16, a conveyor C2 that moves the label suction unit C1, and a controller C3 that controls the operation of the conveyor C2.

Figure 2:
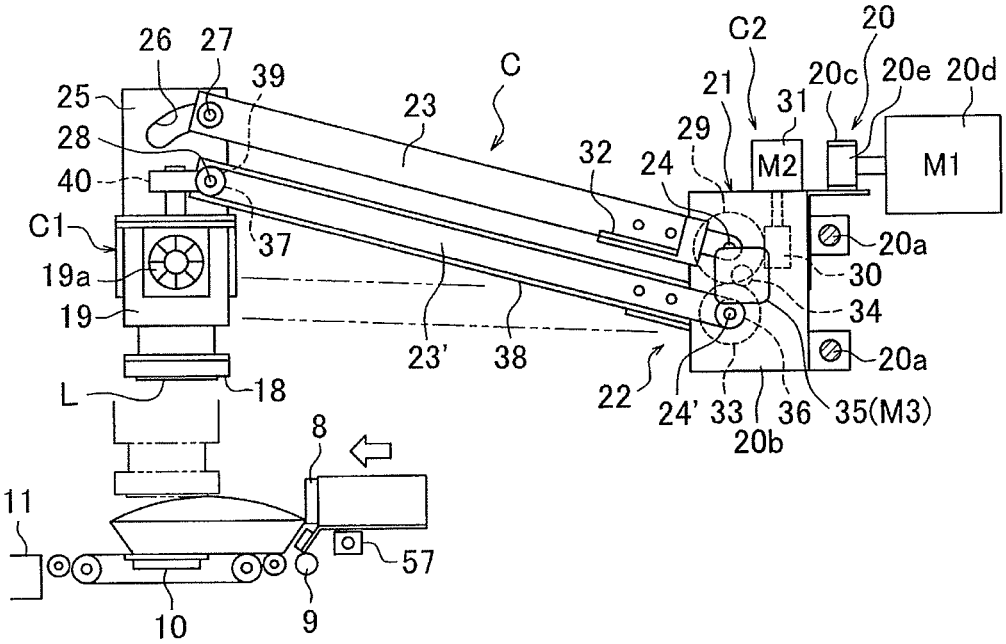
FIG. 2 is an enlarged side view showing a unit of a label affixing device according to an embodiment of the present invention.

As shown in FIG. 2, the label suction unit (affixing unit) C1 consists of a label suction surface 18 that suctions and holds the label, and a suction box unit 19 that generates a label suction force at the label suction surface 18. The suction box unit 19 has a fan 19*a*, and the rotation of the fan 19*a* causes a negative pressure to be generated inside the suction box unit 19 thereby generating a label suction force at the label suction surface 18.

The conveyor C2 moves the label suction unit (affixing unit) C1 which is configured by a first conveyor 20 for moving the label suction unit C1 in a direction at right angles to the transporting direction of the packaged goods G', that is, in the width direction of the ejection path (heat seal unit) 10 via which the packaged goods G' are ejected and the ejector 11 connected to the ejection path; a second conveyor 21 for moving the label suction unit C1 in an up and down direction with respect to the transporting surface for the packaged goods G'; and a third conveyor 22 for rotating the label suction surface 18 of label suction unit C1 within a horizontal plane parallel to the transporting surface for the packaged goods G'.

The first conveyor 20 is configured by two guide rods 20*a* horizontally fixed at right angles to the pushing direction of the pusher type ejector 8 located at the upper position of the packaging unit 3 of the stretch film packaging machine; a case 20*b* fitted together with the guide rods 20*a* so as to slidable thereon; an endless belt 20*c* arranged parallel along the guide rods 20*a*; a stepping motor (horizontal movement motor) 20*d* configured to cause the endless belt 20*c* to move and travel in the forward and reverse directions; and a pulley 20*e*. The case 20*b* is coupled with and fixed to the endless belt 20*c*, and the guide rods 20*a* are mounted through a bracket onto the machine frame 14. The case 20*b* moves along the guide rods 20*a* by the operation of the stepping motor 20*d*. In other words, the first conveyor 20 moves by means of the stepping motor (horizontal movement motor) 20*d* in the left and right directions (in the width direction of the ejection path), and can thus be driven to move by minute width increments.

The label suctioning unit (affixing unit) C1 is mounted at the distal end of a top and bottom pair of parallel arms 23, 23' which support the label suction unit C1 to move by means of the second conveyor 21 in the up and down directions with respect to the packaged goods G'; the pair of parallel arms 23, 23' is mounted by the proximal ends thereof to the case 20*b* which moves along the guide rods 20*a*.

The pair of parallel arms 23, 23' which hold the label suction unit (affixing unit) C1 are mounted at each proximal end side on two horizontally fixed pins 24, 24' so as to be rotatable within a prescribed space in the up and down direction with respect to the case 20*b*. At the other end side (the distal end side), the upper parallel arm 23 is connected, so as to be movable, to a horizontally fixed pin 27 fitted together with a circular groove 26 in a mounting tube 25 connected at the upper part of the label suction unit; and the other end side (the distal end side) of the lower parallel arm 23' is mounted, so as to be rotatable, on a horizontally fixed rotation shaft 28 positioned on the lower side of the pin 27 and fits together with the mounting tube 25 so as to be rotatable. Therefore, with the rotation shaft 28 as the center, the label suction unit C1 can bob and swing freely in the transportation direction of the packaged goods G', and the circular groove 26 defines range of the bobbing and swinging of the label suction unit C1. In addition, the second conveyor 21 mounted on the proximal end side of the previously described upper parallel arm 23, and rotates the label suction surface 18 of label suction unit C1 within a horizontal plane, and the third conveyor 22 is mounted around the perimeter of the lower parallel arm 23'. Moreover, within case 20*b* there is provided an angle maintaining mechanism for maintaining the angle of inclination when the label suction unit C1 bobs.

The second conveyor 21 is configured by a gear 29 secured by the pin 24 that supports the upper parallel arm 23 at the proximal end thereof; a gear 30 secured to the rotation shaft of a stepping motor 31 (for vertical movement) installed on the upper surface of the case 20*b* that engages the gear 29 and causes said gear 29 to rotate when driven; and a supporting arm 32 integrally secured across both parts of the pin 24 that juts out externally from the case 20*b*. The upper parallel arm 23 is supported from its lower surface by the supporting arm 32 and is supported so as to be movable with respect to the pin 24.

Thereby, in the second conveyor 21, as the stepping motor 31 rotates, the pin 24 rotates via movement of gear 30 and then gear 29 and supporting arm 32 moves in the up and down directions by rotation of the pin 24. Thus, the upper parallel arm 23 rotatably supported by the pin 24 and supported underneath by the supporting arm 32, moves up and down in response to the up and down movement of the supporting arm 32 while being freely movable with the pin 24 as the center in an upper region as it moves out of contact with the supporting arm 32.

As shown in FIG. 2, the third conveyor 22 is configured by a gear 33 secured to one side end of a pin 24' supporting the lower parallel arm 23' at the proximal end side thereof; a gear 34 secured to the rotation shaft of a stepping motor (horizontal rotation motor) 35 mounted on the exterior of the case 20*b* through a bracket that engages the gear 33; and a sprocket 36 secured to the other side end of the pin 24'. The third conveyor 22 further includes, a sprocket 37 secured to one side of the horizontally fixed rotation shaft 28 rotatably fitted to the mounting tube 25 which is secured to the previously described label suction unit C1; a toothed belt 38 is wound and extended over the sprocket 37 and the sprocket 36, and a gear 39 secured to the middle portion of the rotation shaft 28; and a gear 40 secured to a supporting shaft integrally engaging and supporting the label suction surface 18 that engages the gear 39. (For specific details of the conveyor, see Japanese Published Patent Application No. H09-77034).

Figure 3:
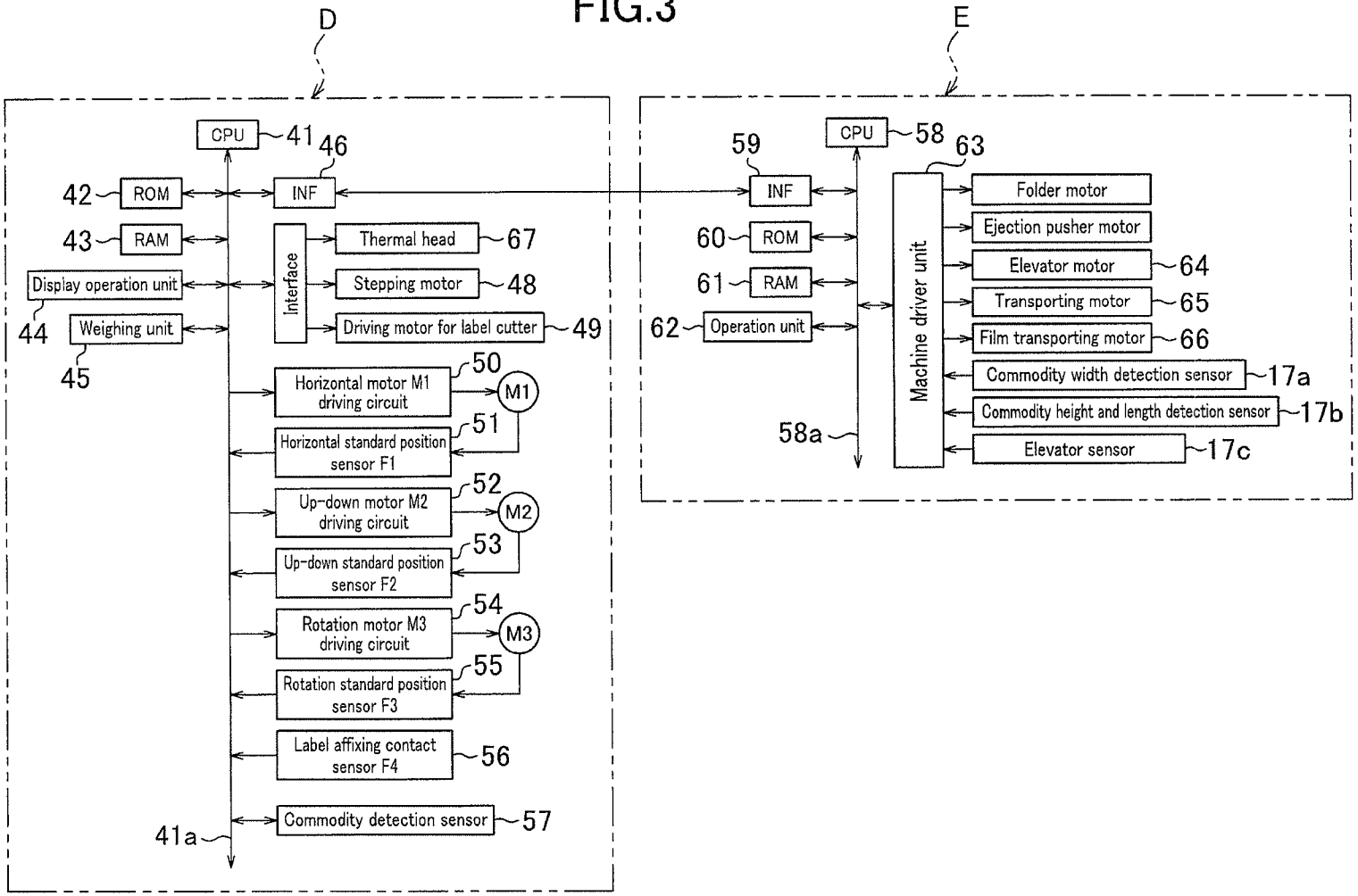
FIG. 3 is an explanatory diagram showing the electrical structure of a control means for the device in FIG. 1.

FIG. 3 shows a block diagram of the electrical structure of the above described device wherein a label issuing unit controller D and a packaging machine control unit E are provided.

The label issuing unit controller D controls primarily the functions of the label issuing unit, and is controlled by a CPU 41.

The packaging machine control unit E controls primarily the components of the stretch film packaging machine A and is controlled by a CPU 58.

Next, the structure of the label issuing unit controller D will be explained. Connected to the CPU 41 over a bus 41*a* are a ROM 42, a RAM 43, a display operation unit 44 (a console unit 12), a weighing unit 45, an interface circuit for communication (INF) 46, an interface for communicating with a thermal head 67, a stepping motor 48 that drives the platen roller, a cutter driving motor 49 that drives the cutter (label cutter) 69 that cuts a linerless label sheet L' printed on by the thermal head, a driving circuit 50 for the horizontal motor M1 which causes the label suction unit C1 to move, a horizontal standard position sensor F1 (51), an up-down motor M2 driving circuit (52), an up-down standard position sensor F2 (53), a rotation motor M3 driving circuit 54, a rotation standard position sensor F3 (55), a label affixing contact sensor F4 (56), and a commodity detecting sensor 57. Each type of control programs executed by the CPU 41 is stored in the ROM 42.

The RAM 43 is provided with registers, areas for storing flags, and so forth, and areas for storing pre-set data such as each type of data pre-stored pertaining to each commodity and this information is used by the CPU 41 when executing control programs stored in the ROM 42. Stored in the preset data storage area is a commodity file (see FIG. 4) for storing commodity data in association with goods to be packaged G, the price calculation and label print data such as commodity name, unit, barcode, and so forth; a label format file (see FIG. 5) defining the format for printing a label and a tray file (see FIG. 6), and so forth. The details of each file format will be described below.

The display operation unit 44 (console unit 12) is provided with an operation unit constituted by a keyboard and touch panel, and a display unit constituted by liquid crystal display. The display operation unit 44 (console unit 12) displays input data, displays preset data (readout), or displays each type of message on the basis of the input of each type of data or the input of a command, or commands from the CPU 41. Therefore, the input and so forth of each type of data relating to the affixing of a linerless label can operates the operation unit of the display operation unit (console) 12.

The weighing unit 45 supplies to the CPU 41 a weight signal for the goods to be packaged G that are placed on the commodity stage 13.

The communication interface circuit (INF) 46 is a circuit for communicating each type of data or command to the packaging machines control unit E.

The printing unit of the label issuing unit B configured by a thermal head 67, a stepping motor 48 for driving the platen roller, and a cutter driving motor 49, prints on the basis of a command from the CPU 41 the commodity name, price, unit of measure, barcode and so forth to the linerless label tape, cuts the printed label from the label tape into an individual linerless label using the cutter (label cutter) 69 and dispenses said linerless label L at the label dispensing outlet 16.

The horizontal motor M1 driving circuit 50 for moving the label suction unit (affixing unit) C1 drives the horizontal motor M1 (the motor 20*d* of the first conveyor 20) to move the label suction unit horizontally, specifically, to move the label suction unit C1 in horizontal, i.e., in the direction at right angles to the transporting direction of the packaged goods G'; and a stepping motor is used as the horizontal motor M1. Accordingly, it is possible to detect the position of the label suction unit C1 by counting the number of driving pulses for the stepping motor (when there is rotation to the right the count is positive, and when there is a rotation to the left the count is negative).

The horizontal standard position sensor F1 (51) detects if the label suction unit C1 is at a standard position in the horizontal direction; counting the driving pulses starting at the standard position, will determine the position of the label suction unit C1 in the horizontal direction.

The up-down motor M2 driving circuit 52, and the up-down motor M2 standard position sensor F2 (53), except the up-down motor M2 (that is the motor 31 for the second conveyor 21), moves the label suction unit (affixing unit) C1 in the up and down directions, function identically to the horizontal motor M1.

Further, the rotation motor M3 driving circuit 54 and the rotation standard position sensor F3 (55), except that the motor 3 (that is the motor 35 for the third conveyor) causes the label suction unit (affixing unit) C1 to rotate within a plane parallel to the surface of the ejection of the packaged goods G' and the fact that the position determined from counting the drive pulse of the motor M3 is not a distance but an angle, function identically to the horizontal motor M1.

The label affixing contact sensor F4 (56) senses whether the linerless label L is affixed to the packaged goods G'; that is, the label affixing contact sensor F4 (56) detects whether the <<label>> suction surface 18 of the label suction unit C1 has come into contact with the packaged goods G', and detects whether the upper parallel arm 23 has separated from the supporting arm 32 by detecting whether no less than a constant force has been applied in the upward direction to the label suction unit C1.

The commodity detecting sensor 57 arranged laterally to the ejection path 10 (heat seal unit), and to a certain extent in front (towards the packaging unit 3) of the label affixing position so that the label suction unit (affixing unit) C1 is able to descend vertically, detects the presence of the packaged goods G' on the ejection path, and generates a label affixing signal. Thus, the commodity detecting sensor 57 supplies a signal indicating when the packaged goods G' is at the label affixing location, that is, moves into position on the ejection path (heat seal unit) to CPU 41.

Next, the packaging machine control unit E will be explained. The CPU 58 is connected via a bus 58*a* to communication interface circuit (INF) 59, a ROM 60, a RAM 61, an operation unit 62, and a machine driving unit 63.

The communication interface circuit (INF) 59 is for communicating with the label issuing unit controller D, as well as communicating each type of data and command.

The ROM 60 stores the control programs executed by the CPU 58.

The RAM 61, besides the areas for storing each type of register and flag used when CPU 58 executes the control programs stored in ROM 60, also stores each type of table used in determining a control data on the basis of a commodity format data (length, width, height).

The operation unit 62 is a switch for controlling the ON and OFF of the weighing pricing and packaging device.

The machine driving unit 63 drives each component of the packaging machine during packaging; specifically, the machine driving unit 63 drives a motor 64 that drives the elevator 2, a transport motor 65 that drives the pusher type conveyor transporting the goods to be packaged G, a film transfer motor 66 for the film feeder 5, and so forth. Furthermore, while the structure of the packaging machine has been heretofore briefly explained, given that the packaging machine is not directly related to the present invention per se, detailed explanations of the control of the motors and so forth with will be omitted.

Finally, also connected to the machine driving unit 63 are a commodity width detecting sensor 17*a* that detects the width of the goods to be packaged G, and a height and length detecting sensor 17*b* that detects the height and length (depth) of the goods to be packaged G, both sensors supplying detection data to the CPU 58.

The commands and data transferred between the label issuing unit controller D and the packaging machine control unit E related to the present invention are the signal from the label issuing unit controller D to the packaging machine control unit E sent to report that the weight of the goods to be packaged G placed on the commodity stage 13 has stabilized; and, the signal from the packaging machine control unit E to the label issuing unit controller D sent as the data for determining the label affixing position including a length data (the length data in the width direction taken from the center of the commodity to the edge part of the commodity) detected by the commodity width detecting sensor 17*a*, and the height data and length (depth) data detected by the height and length (depth) detecting sensor.

FIG. 4 is an explanatory diagram showing the data structure of a commodity file managed by the label issuing unit B (linerless label printer) according to the current embodiment of the present invention. In the commodity file, values for elements such as the "commodity code", "commodity name", "price", "barcode", "additives", "label format" and "tray format" and so forth are set.

A label format number representing a label format file is set and stored under the "label format". In addition, a tray file number representing a tray file is set and stored under "tray format".

FIG. 5 is an explanatory diagram showing the data structure of a label format file managed by the label issuing unit B (linerless panel printer) according to the current embodiment of the present invention. Each type of configuration for the print format for a linerless label can be configured in the label format file wherein there are elements such as a format number for identifying a particular type of format; the label length which determines the length the a label sheet (tape) is cut; further, a commodity name, the additives, ingredients, price, barcode data, units of measure, the sell-by date, the production date and the name of the seller and so forth are stored as print items. For each of these print items the following values are set and stored in the label format file: a print position (indicating the leftmost edge of the print range where the top left is designated by (0,0)), the height of the print range in the transporting direction of the label sheet (the linerless label tape), the length which is at right angles to the height of the print range, and a font identifying the type of character font.

FIG. 6 is an explanatory diagram showing the data structure of a tray file. The following elements can be configured in a tray file: a tray file number identifying the tray file; for each tray file number the width, length (depth), height, package weight, label affixing position (that is the data representing the distance from the edge part of the tray to the center of the label: X0, Y0) (affixing position information), movement (horizontal moving distance of the affixing unit: X), timing (the timing for the descent of the label suction unit (affixing unit) C1 after the pusher type ejector operates: T), 90-degree rotation (a flag for identifying whether or not the affixing unit should rotate the suctioned and held linerless label 90 degrees), and 180-degree rotation (a flag for identifying whether or not the affixing unit should rotate the suctioned and held linerless label 180 degrees). In addition, the width, length (depth), and height data values for a tray are described as being set, however, since these values can be detected by the width detecting sensor 17*a*, and the height and length detecting sensor 17*b*, the values do not need to be set. Alternatively, if the width detecting sensor 17*a*, and the height and length detecting sensor 17*b* are not provided and the above respective values are not detected automatically, each width height length (depth) value may be configured in the tray file, so that the values retrieved from the tray file when packaging begins.

The label position (X0, Y0) on the tray (having packaged goods G') is the distance from meeting ends of the tray to the center of the label. For example, for a tray of width 200 mm and length 150 mm, as shown in the example in FIG. 7(*a*) the label affixing position is set as X0=30 mm and Y0=130 mm. In this case there is a blank range between the outer circumference of the label on the tray, and the end part of the tray.

Further, in the case the rotation angle is zero degrees (0 degrees) the moving distance (the horizontal moving distance) X is obtained from the previously inputted tray end part to label center distance (X0, Y0) and the width of the tray during the packaging process once the width of the tray is detected. The label suction unit (affixing unit) is controlled to move on the basis of the calculated moving distance X and timing data T. However, the tray file used may be associated with a label affixing data file and the moving distance X and timing data T may be calculated before the packaging operation. In other words, the tray is placed in the center of the commodity stage 13, and since the width of the tray (L), and the distance from the end part of the tray to the center of the label X0 is known, the moving distance X can be determined.

For instance, if the rotation angle is zero degrees (0 degrees), the moving distance X can be determined by the width of the tray (L) and the inputted value for X0. As described below, the timing data T is determined by the inputted value for Y0, and the (constant) transporting speed of the packaged goods G' transported by the pusher type ejector 8.

Additionally, a label standby position (X, Z) can be calculated on the basis of the width data for the tray, the X0 data inputted in the label affixing data file, and further the height data H for the commodity.

This label standby position (X, Z) is the moving distance data representing the moving distance to the position where the label suction unit C1 suctions and holds a label dispensed at the label dispensing outlet 16 (the initial position) in standby in order to affix the label to the packaged goods G'. "X" represents the horizontal distance from the initial position of the label to the label standby position and "Z" represents the perpendicular distance from the initial position of the label to the label standby position. See FIGS. 7(*b*) and 7(*c*). Moreover, the initial position is the label dispensing position in FIGS. 7(*a*) and 7(*b*), and the position at which the affixing unit suctions the dispensed label and begins movement.

The moving distance in the horizontal direction X=XC−LR+X0. (See FIG. 7(*b*)).

Where,

XC is the distance from the initial position of the label suction unit C1 to the center of the transporting path (the center of the commodity.

LR is detected (measured) by the commodity width detecting sensor 17*a*.

And X0 is a value set by input.

The moving distance in the horizontal direction X is determined from the above values.

The moving distance in the perpendicular direction Z=(Z0−Z2)−H. (See FIG. 7(*c*)).

Where,

Z0 is the perpendicular distance from the initial position of the label suction unit (affixing unit) C1 to the transporting surface of the packaged goods G' (the article to be labeled) and is a constant value determined by the machine components.

Z2 is the perpendicular distance from the label standby position to the position the label contacts the surface of the packaged goods G', and is set to be a constant value in order to avoid non-conformity of the label contact position that occurs according the changes in height of the packaged goods G'.

H is the height of the packaged goods G' and is detected by the commodity height and length detecting sensor 17*b*.

In addition, the timing (T) for affixing a label starts from the time (T=0) a packaged good G' is detected by a commodity detecting sensor 57 positioned immediately before the ejection path 10 (heat seal unit) until the delay between when the label suction unit C1 moving from a standby position until it begins its descent; the timing (T) determines the label contact position on the packaged goods G' in the Y axis direction. Accordingly, if Y0 is set to zero (0) at a time T=T', if the transporting speed of the packaged goods G' is D mm per second, the affixing timing T is obtained by T=T'+Y0/D. Y0 is an affixing condition and is set via input.

Whether or not a label should be rotated is ascertained when a tray file is read and for example, if the 90-degree rotation flag has been set, the driving of the third conveyor 22 is controlled on the basis thereof.

However, for example, if the label length of the linerless labels L affixed to the same type (size) of tray (the article to be labeled) differs, if the label is affixed to the basis of the affixing position, the affixing position will be out of place. Below, the shifting out of place of the affixing position is explained on the basis of FIG. 8.

Figure 8A:
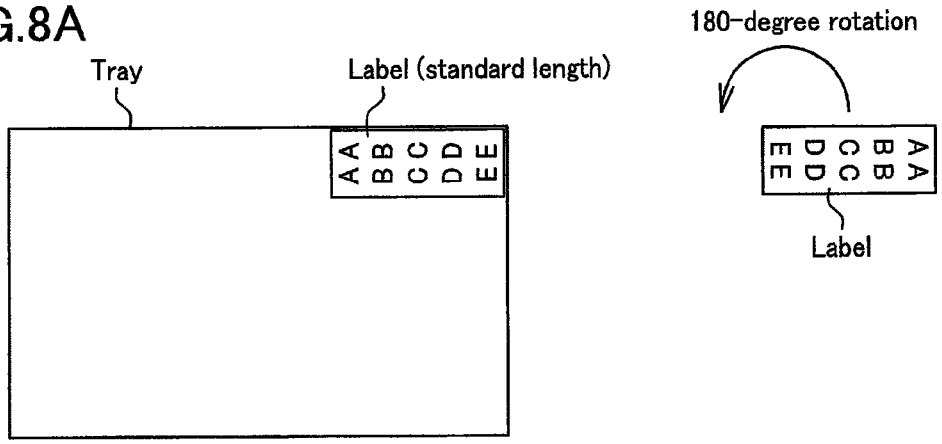
FIG. 8 shows the states of an affixed label when labels with different label lengths are rotated 180 degrees and affixed (horizontally affixed) at a prescribed position on a tray where, FIG. 8 (*a*) shows the state of an affixed label when the affixing unit affixes a label of standard label length.
Figure 8B:
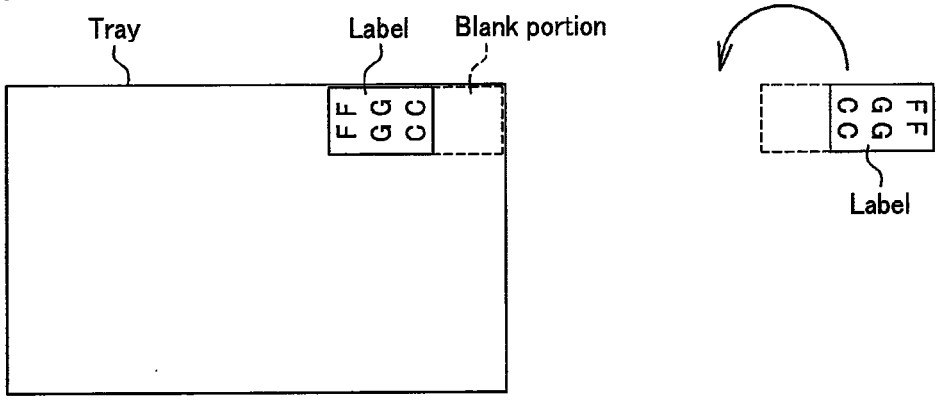
Figure 8C:
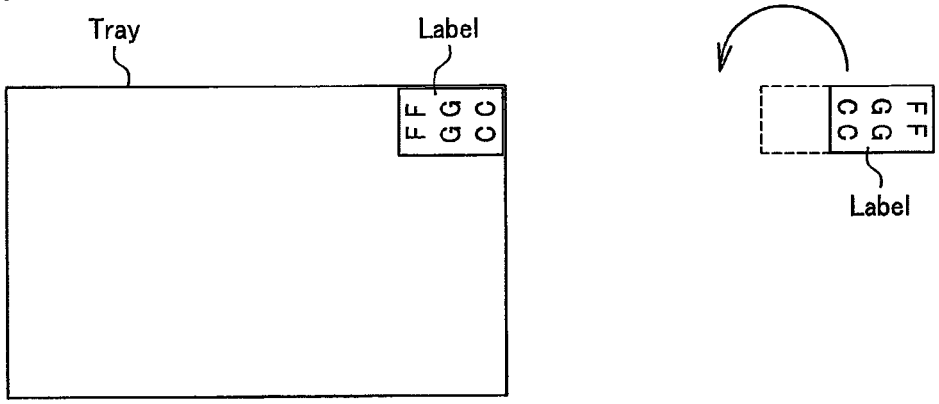

For example, in FIG. 8(*a*) shows a case where a standard sized label is printed with print items AA, BB, CC, DD, EE, dispensed and rotated 180 degrees; the affixing condition set is that the label is to be affixed at the top right position on the ejected tray. AA and BB represent the commodity name, and the print area (for instance, the number of lines) is set in the label format file so that the commodity name can be printed. CC, DD, and EE represent, for example, the additives of the commodity, and the print area (for example, the number of lines) is set in the label format so that the all the information regarding the additives is printable.

Whereas, as shown in FIG. 8(*b*), for example when the commodity is different, FF, GG are printed to the label as the commodity name, and CC is printed to the label as the additive.

In this case, with respect to the label for the commodity AA, BB, the label for the commodity FF, GG has printed only the additive information CC in common, and thus, compared to the label for the commodity AA, BB the print area has two lines of blank space, and therefore the label sheet is cut shifted up by that space.

That is to say, when a label (commodity AA, BB) having the label length (standard length) retrieved from the printing format is affixed to a tray, as show in FIG. 8(*a*), the label can be affixed at the top right position on the tray, however, if the label for commodity FF, GG is affixed in the same manner and the moving distance in X axis direction of the label suction unit C1 is made the same, as shown in FIG. 8(*b*) the label affix is out of position by just the amount the label length has shortened, and a blank portion greater that the allowed amount appears between the right side of the edge and the side end of the label.

In addition, shortening the moving distance of the affixing unit in the X axis direction from the standard moving distance for a standard label length by just the amount the label has become shortened may be used as a method for correcting the left to right horizontal direction movement of the label suction unit C1 (affixing unit). The moving distance can be calculated for each tray if the affixing position (X0, Y0) of the label on the tray is set and if the moving distance for label length of a standard label is previously retrieved as the printing format, and thereby the label can be affixed at a previously set prescribed location, as shown in FIG. 8(*c*). In other words, from FIG. 7(*b*) the moving distance X=XC−LR+X0 ((the standard label length retrieved)−(the determined label length)).

In the above mentioned example, when the label length is determined to be shorter than the standard length as in FIG. 8(*b*), the label is moved to the top right and then affixed. That is to say, the above mentioned example illustrates the case where the moving distance X becomes shorter however, in the case the label length for the label is determined to be longer than the standard length as in FIG. 8(*b*) it is necessary to move the label suction unit C1 towards the left direction, therefore the moving distance X is lengthened by just the amount the label is determined to be longer than the standard label length and thereby the label can be affixed similarly as shown in FIG. 8(*a*). In other words, it is ensured that the affixing position (X0, Y0) of the label on the tray is set, the printing format is retrieved, from the retrieved printing format the label length and the label length of a dispensed label are compared, if the dispensed label is shorter, the moving distance of the affixing unit in the X axis direction is shortened by just the amount the label length of the dispensed label is shorter. Further, if the label length of the dispensed label is longer, the moving distance of the affixing unit in the X axis direction is lengthened by just the amount the label length of the dispensed label is longer. Hereby, a dispensed label can be affixed on the tray at a set affixing position (X0, Y0).

Figure 9A:
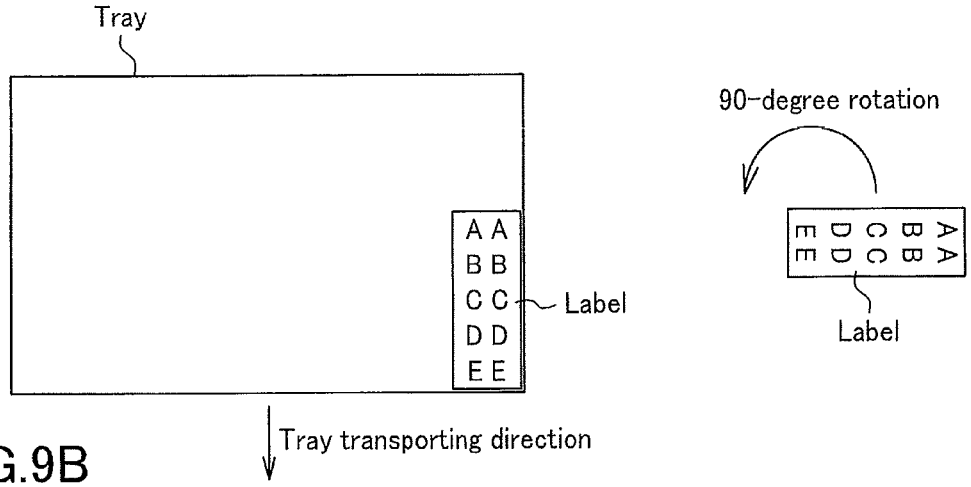
FIG. 9 shows the states of an affixed label when labels with different label lengths are rotated 90 degrees and affixed (vertically affixed) at a prescribed position on a tray where, FIG. 9 (*a*) shows the state of an affixed label when the affixing unit affixes a label of standard label length.
Figure 9B:
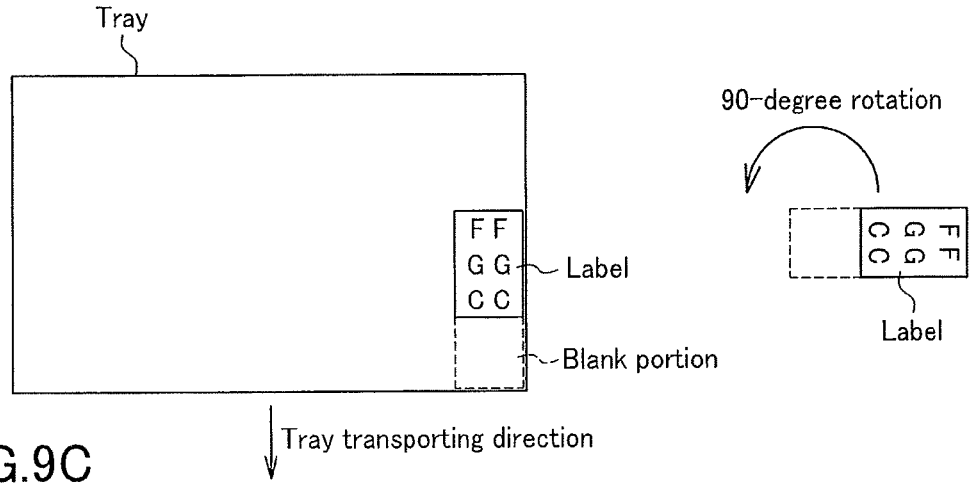
Figure 9C:
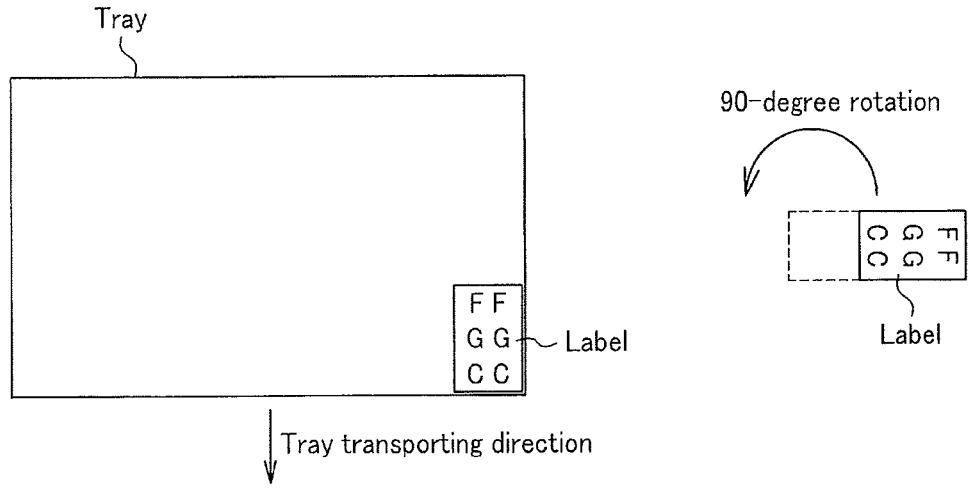

Another example is shown in FIG. 9(*a*) and FIG. 9(*b*). In FIGS. 9(*a*) and 9(*b*) are shown the same labels as in FIGS. 8(*a*) and 8(*b*) when the labels are rotated 90 degrees, and the labels are affixed (vertically affixed) at a lower right position. In this case, a label suctioned and held by the affixing unit can be affixed at the aforementioned lower right position by modifying the timing of the descent of the affixing unit. However, if the timing of the descent for a label for commodity FF, GG which is a label with a shorter label length compared to a label with the label length (standard length) retrieved from the printing format (a label for commodity AA, BB), is the same timing used for the label of standard length, as shown in the figures, the label is affixed out of position, and a blank portion appears between the lower side edge of the tray and the lateral end of the label.

Figure 7A:
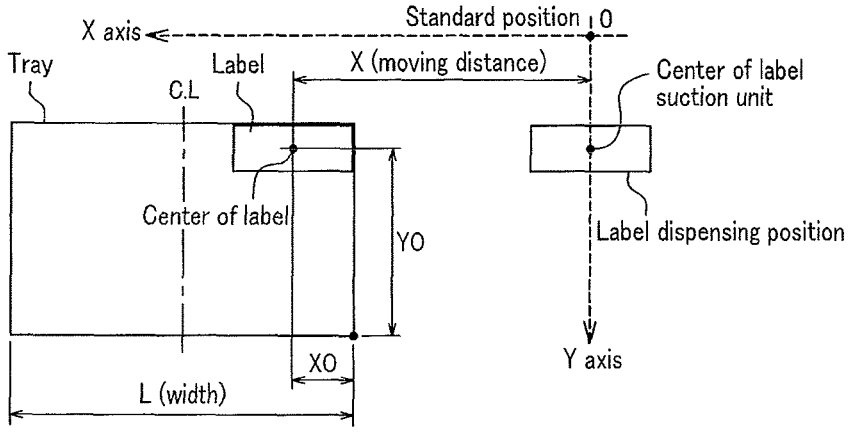
FIG. 7(*a*) is an explanatory diagram showing the positional relationship of a label affixed to a tray.
Figure 7B:
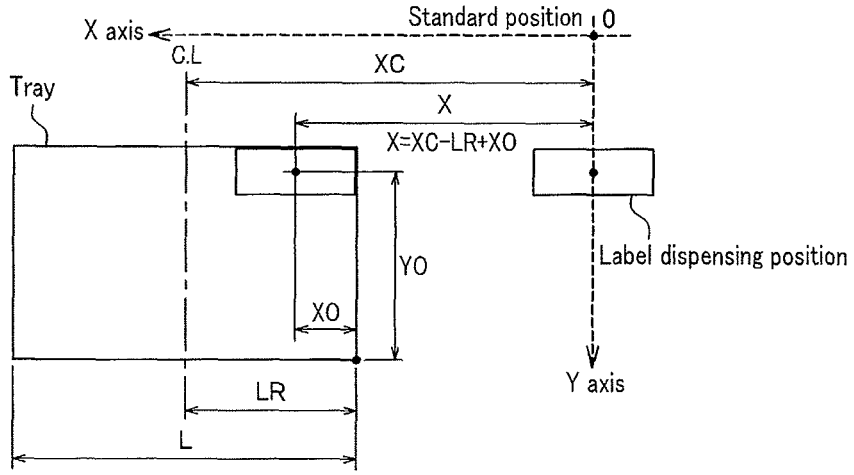
Figure 7C:
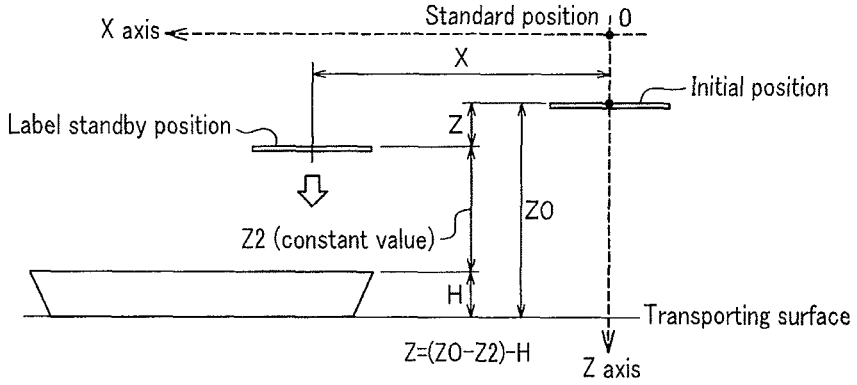

When the affixing position of the label is as shown in FIG. 9(*a*) set at a position at the lower right (X0, Y0) of the ejected tray, the timing for the descent of the standard label length is calculated by means of an operation based on FIG. 7. That is, as previously described, the time T for affixing a label is the delay from the time (T=0) that the commodity detecting sensor 57 detects the packaged goods G' until the time the label suction unit C1 begins a descent from its standby position, and the timing T determines the label contact position on the packaged goods G' in the Y direction. Therefore, if Y0 is set to be zero (0) at a time T=T', and if the transporting speed of the packaged goods G' is D mm per second, the affixing timing T is obtained by T=T'+Y0/D. Y0 is an affixing condition and is previously set via input.

Then, the label is affixed at the previously set affixing position (X0, Y0) over the tray, however for instance, when the label length of the printed and dispensed label is shorter than the label length of the printing format (standard label length), by speeding up the descent time by just the amount the label is shorter, the label can be affixed at a previously set prescribed location.

For example, when the standard label length is 60 mm and the label length of the printed and dispensed label is 40 mm, the label is 20 mm shorter than the standard label length. The amount by which to speed up the descent time may be calculated with respect to the 20 mm shorter portion. Here, given that the driving speed of the pusher type ejector is constant (for instance 10 mm/s) as well as the standby position and the descent speed of the affixing unit, for the label length shorter by 20 mm, if the descent is made two seconds (2 s) faster, as shown in FIG. 9(*c*) the label can be affixed at a previously set prescribed location.

Further, the above mentioned example illustrates the case where the label length is shorter and wherein the timing for lowering the affixing unit is sped up in relation with the amount the length of the label is shorter, however, in the case it is determined that the length of the dispensed label is longer than the standard label length, the timing for lowering the affixing unit may be controlled to be delayed in relation to the amount the length of the label is longer.

In this way, in the present invention, the affixing out of position that occurs with linerless labels with different label lengths being affixed to the same tray does not occur, and the movement of the affixing unit is corrected and controlled in relation with the label length so that the label may be affixed at the correct position. Thereby, problems where the label juts out from the labeled article, or possibly the amount of blank space from between a prescribed location (for example, the bottom right corner on the front face of the labeled article (packaged goods)) and the affixed position is not constant, and so forth, and there is a lack of uniformity between the affixed position and the position setting for the label, will not occur.

Figure 10:
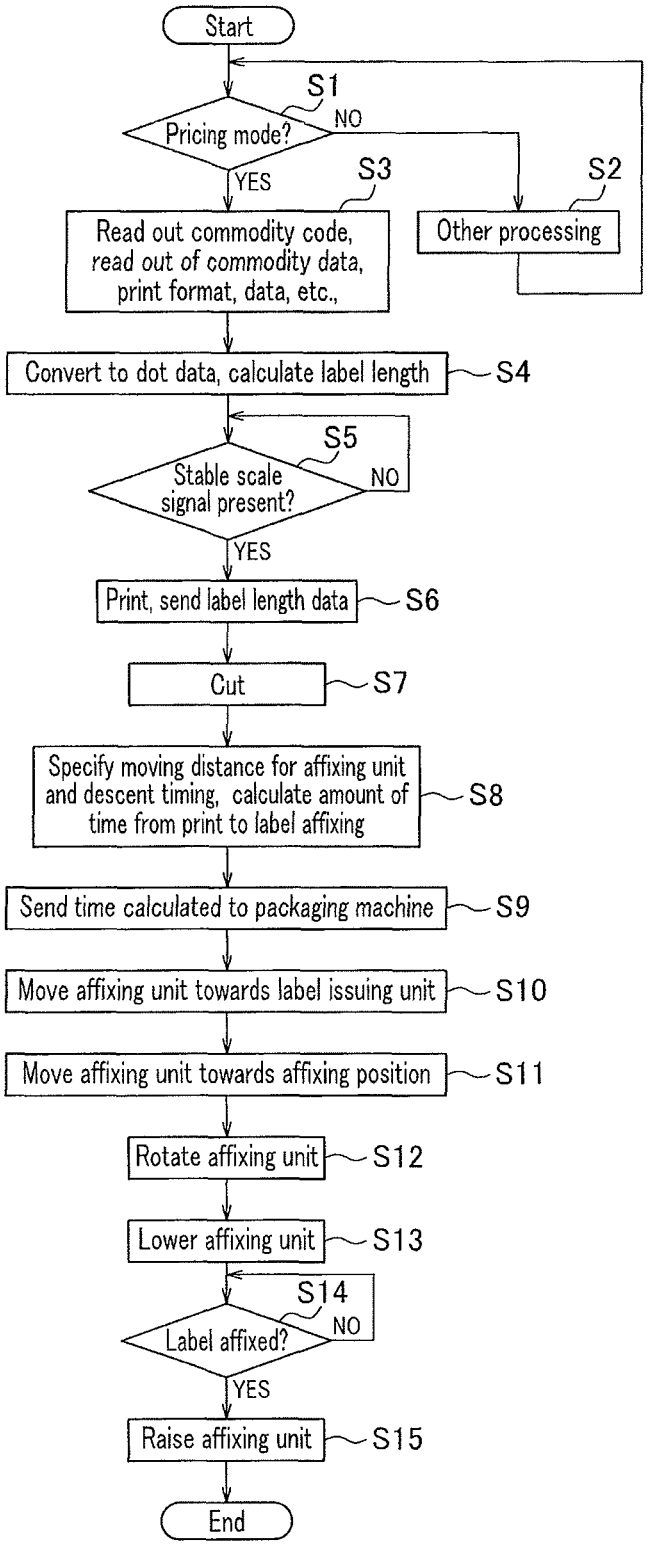
FIG. 10 is a primary flowchart for explaining the operation of a label issuing unit (a linerless label printer) according to an embodiment of the present invention.
Figure 11:
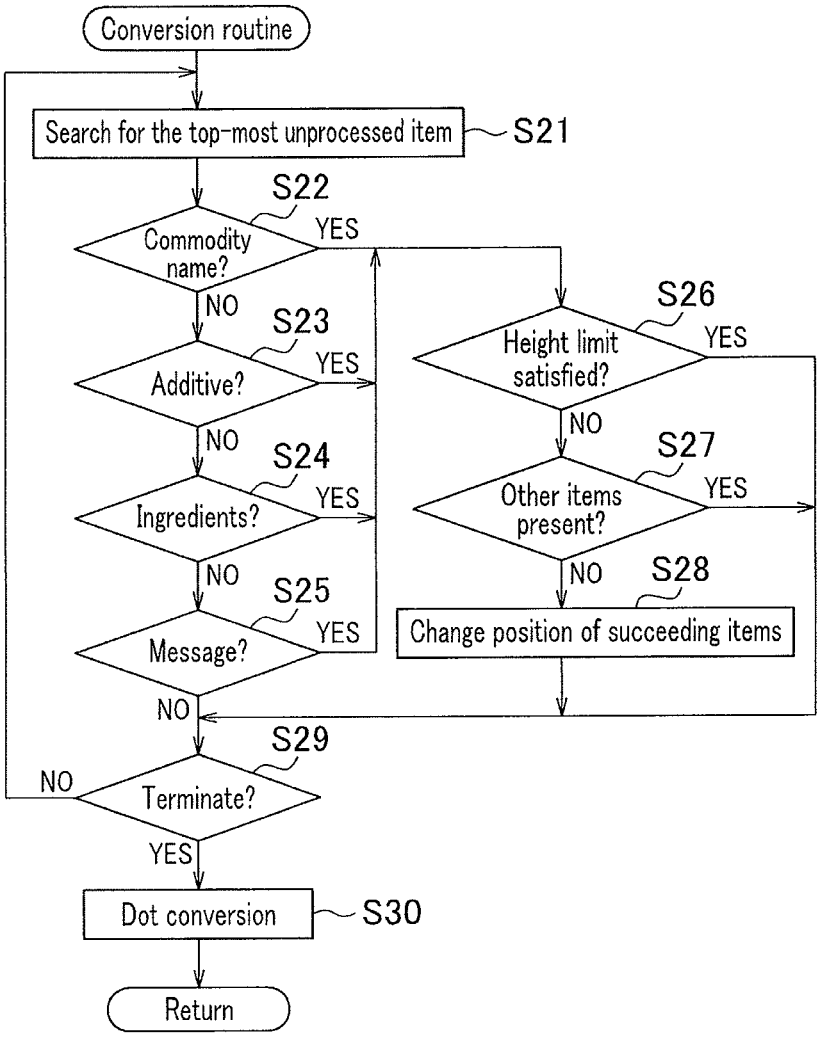
FIG. 11 is a flowchart for explaining the operation of a conversion routine according to an embodiment of the present invention, used to create dot image data.

Next, the processes for printing and dispensing a label by the label issuing unit B (linerless label printer) are explained based on FIG. 10 and FIG. 11. FIG. 10 is a primary flowchart for explaining the operation of a label issuing unit B according to the current embodiment of the present invention.

Step S1. The label issuing unit B references RAM 43 and determines whether or not the current mode is a pricing mode for issuing a label. If the label issuing unit B determines the current mode is not a pricing mode (NO), it continues to step 2. If the label issuing unit B determines the current mode is a pricing mode (YES), it continues to step 3.

Step S2. The label issuing unit B performs according to each mode: file data setup in setup mode, output of machine operation report in reporting mode, machine maintenance operations in maintenance mode and so forth, and then returns to step 1.

Step S3. The label issuing unit B using a display operation unit (data retriever) 12 and retrieves from the operator, the commodity code for the commodity data to be printed. The label format number and tray format number are stored in association with each other in the commodity file, and therefore, for instance, when the label format number "#1" is set as the commodity code specified in the commodity file, the label issuing unit can retrieve the format data, for example the label length data, and the print area information for each print item, specified by the format number "#1". Furthermore, within the format data specified by the format number "#1", the commodity name is designated to have three lines and the additives are designated to have four lines in the print range. (See FIG. 13 (*a*)). Additionally, a tray file set in association with a tray number can be read from the tray format number set in association with the commodity code, and the label issuing unit can retrieve from a tray file information such as the width, height length (depth); the label affixing position (X0, Y0); the horizontal moving distance X of the affixing unit within the device; the timing at which to lower the affixing unit, whether or not to rotate the affixing unit 90 degrees or, possibly 180 degrees, and so forth.

When the commodity code '0001' has been specified, the commodity data of the commodity identified by commodity code '0001' (for example the commodity name, price, additives and so on) are retrieved as the commodity data for a commodity. Moreover, the additives for the commodity identified by the commodity code '0001' are given one line respectively of the amount of data for printing (See FIG. 4).

Step S4. The label issuing unit B converts the print data for the commodity data retrieved in this step S4 to dot data in accordance with the format retrieved in step S3. The details of the conversion are explained at FIG. 11. In the case the printing position in the sheet transporting direction of the below described step 28 of FIG. 11 are shifted upwards, the number of lines shortened is subtracted from the label length data in the label format area retrieved from step S3, and the label length is thereby calculated. In other words, the label issuing unit retrieves the standard label length in step S3, and given that the height of each character and further the length of the space between the letters in the ejection direction when printing are determined beforehand, the label issuing unit can calculate the length of the shortened number of lines as well as the length of the label dispensed.

Step S5. The label issuing unit B determines the presence or absence of input of a signal indicating the weight of a commodity placed on the weighing unit 15 of the commodity stage 13 of the stretch film packaging machine has stabilized. If the weight stabilization signal has not been input (NO), the label issuing unit B repeats the determination until a stable signal is input. If the weight stabilization signal has been input (YES), the label issuing unit B proceeds to step S6.

Step S6. The label issuing unit B controls the thermal head 67, and the platen roller to print on the linerless label tape on the basis of dot data converted at step S4. Then, the label length data calculated at step S4 is sent to the packaging machine control unit E.

Step S7. The label issuing unit B controls the cutter, cuts the linerless label tape, and thereby dispenses an individual linerless label sheet. For example, in the case that in step 3 the format for format number '#1' is retrieved and in step 4 the commodity data for the commodity with commodity code '0001' is retrieved, the label issuing unit B dispenses a label as shown at the right side of the arrow in the FIG. 13(*a*).

Step S8. The label issuing unit B specifies the moving distance X and the descent timing T of the affixing unit on the basis of the printing format information and tray format information retrieved at step S3; and the label length calculated at step S4; and calculates the amount of time from the printing to the affixing of the label (printing and affixing time).

Step S9. The label issuing unit B sends the calculated time (the printing and affixing time) to the packaging machine control unit E.

Step S10. The label issuing unit B causes the label suction unit (affixing unit) C1 of the label affixer C to move towards the label dispensing outlet (holder) 16.

Step S11. The label suction unit (affixing unit) C1 suctions the label L held at the label dispensing outlet 16, after which the label suction unit (affixing unit) C1 moves to a standby position.

Step S12. The label issuing unit B causes the label suction unit (affixing unit) C1 to rotate on the basis of the setting of the 90-degree rotation and the 180-degree rotation flags associated with the tray number set under the tray format in the commodity file. For example, tray number '1' is set under the tray format element of the commodity code '0001', and given that in the tray file for tray number '1' the 90-degree rotation flag is set, the label suction unit (affixing unit) C1 rotates 90 degrees. (See FIG. 4 and FIG. 6).

Step S13. The label suction unit (affixing unit) C1 begins its descent from the standby position and affixes the label to the packaged goods G'. The timing for the descent of the label suction unit is sped up or possibly delayed in relation to the length difference from the standard label length.

Step S14. The label issuing unit B determines whether or not the label suctioned and held at the label suction unit (affixing unit) C1 was affixed to the top surface of the packaged goods G'. The label presence sensor 56 determines whether or not the label was affixed. The determination is repeated until it is confirmed that a label was affixed; once the label presence sensor 56 senses the label was affixed the label issuing unit B continues to step 15.

Step S15. The label suction unit (affixing unit) C1 ascends, returning to its initial position, and waits at the standby position for the next label to be affixed.

FIG. 11 is a flowchart for explaining the operation of a conversion routine according to the current embodiment of the present invention used to create dot image data.

Step S21. First, in the label format data retrieved in step S3 shown in FIG. 10, if there has been no determination processing (that is, from each of the determination processes in steps S22 to S25 that at least the determination process in step S22 has not been performed), the label issuing unit B searches for the uppermost print item in the sheet transporting direction. For example, if this the first time for the determination process, the uppermost print item is the "commodity name".

Step S22. The label issuing unit B determines whether or not the print item searched for in step S21 is a "commodity name". If the result is that the print item is not a "commodity name" (NO), the label issuing unit B continues to step S23.

Step S23. The label issuing unit B determines whether or not the print item is an "additive". If the result is that the print item is not an "additive" (NO), the label issuing unit B continues to step S24.

Step S24. The label issuing unit B determines whether or not the print item is an "ingredient". If the result is that the print item is not an "ingredient" (NO), the label issuing unit B continues to step S25.

Step S25. The label issuing unit B determines whether or not the print item is a "message".

Further, each print item "commodity name", "additive", "ingredients", "message" determined in steps S22 through S25 are given print items capable of changing their print range (height) in the sheet transporting direction in relation with their respective amounts of print data. More specifically, if the amount of print data (for example the number of lines) is less than the print range (for example the number of lines) in the sheet transporting direction, each of the above mentioned print items are given as print items with a smaller print range.

Step S26. When the print item retrieved as a result of the search is one of a "commodity name", "additive", "ingredients", or "message", (step S22: YES, step S23: YES, step S24: YES, or step S25: YES), the label issuing unit B determines whether or not the print data for the print item fills the height (the print range in the sheet transporting direction) for the print item in the label format data. In other words, for each print item determined YES in steps S22 through S25, the label issuing unit B compares the height (print range in the sheet transporting direction) according to the label format data retrieved in step S3, and the amount of print data in the sheet transporting direction within the commodity data retrieved in step S4, and determines that the amount of print data does not fill the height of the print range if the amount of print data is less than the height in the label format data, and that the amount print data fills the height of the print range if the amount of print data is not less than the height in the label format data. For example, when the print item is a "commodity name", the print range in the sheet transporting direction (height) is three lines, however since the print data is less and is one line, the label issuing unit determines that the print data does not fill the height of the print range.

Step S27. If the label issuing unit B determines in step S26 that the print data does not fill the height of the print item according to the label format data (NO), the label issuing unit B determines whether or not there exists print data for another print item (another print item in the label format data retrieved in step S3) whose position overlaps with the unfilled portion (the surplus portion) and the sheet transporting direction. In other words, another print item having print data the height position thereof overlapping with the unfilled portion (the surplus height portion). That is, the label issuing unit B determines the print data that can be printed in the surplus height portion, from the print data of another print item in the retrieved label format data. For example, if the print item is the "commodity name", the print range in the sheet transporting direction (height) is three (3) lines and the print data is one (1) line, the unfilled portion (the surplus height portion) is two (2) lines, and the print data of each print item is of the "barcode", "price", "unit", "additive", "seller name", the label issuing unit B determines whether or not a print data can be printed in the two-line portion.

In other words, in step S27, if the format data has print items arranged parallel to the sheet transporting direction are retrieved in step 3, when there is an unfilled portion (surplus height portion) in a single print item arranged in parallel with the sheet feeding direction, the label issuing unit B determines whether or not the print data for another print item arranged in parallel has been printed in the unfilled portion.

Step S28. If there are no other print items with print data having height positions that overlaps the surplus height portion (NO), the label issuing unit B, in order to fill in the data towards the top, subtracts the unfilled portion of the height range from the sheet transporting direction position data for all other succeeding items in the print position order in the format data, thereby changing the position of the print items. For example, in step S26 when a determination is made regarding the print item "commodity name", the position data in the sheet transporting direction for each of the barcode, the price, the units, the additive, and the seller name reduces the two lines in "commodity name". That is to say, each print item is filled in and printed with respect to the sheet transporting direction from the two upper extra rows of the "commodity name". Further, the label length data is shortened by the two surplus lines of the "commodity name".

Step S29. The label issuing unit B determines whether or not all items in the retrieved label format data are processed, and if the label issuing unit B determines that all items have not been processed (NO), it returns to step S21. The label issuing unit B continues to step S30 if it determines that all items in the retrieved label format data have been processed (YES).

Step S30. For the print item retrieved in step S21 the label issuing unit B converts into dot data the commodity data of the same item from the commodity data area retrieved, and writes the dot data into a dot conversion area filling in from the top left of the print range of the commodity data. At this time, the label issuing unit B converts the commodity data into dot data on the basis of the position of the format data in the format area retrieved, and the font data. The label issuing unit B then returns to the main routine shown in FIG. 10.

Figure 13:
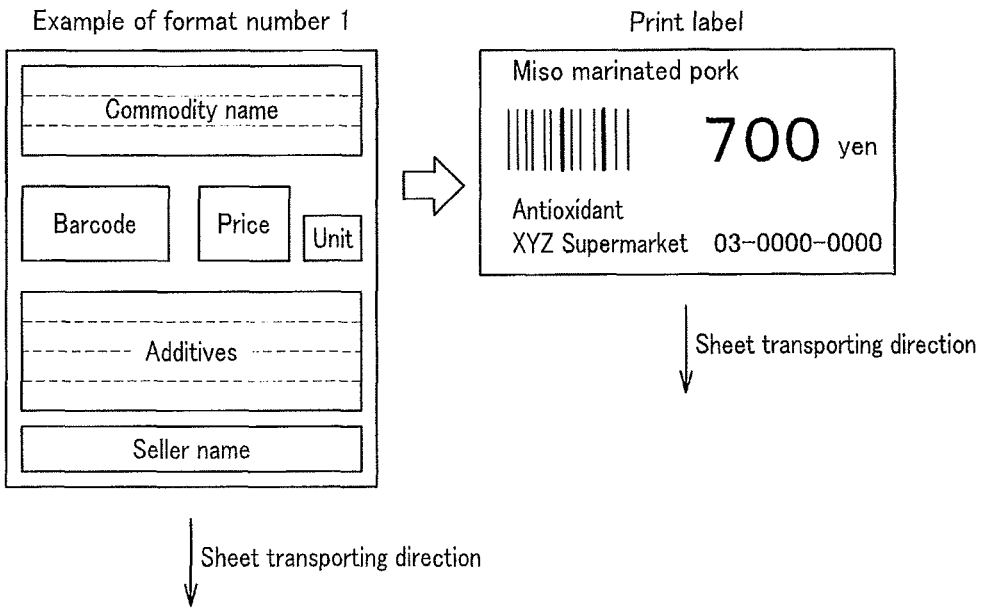
FIG. 13 is a schematic drawing showing one example of a cut linerless label according to an embodiment of the present invention.

On returning to the main routine, if a format number '#1' and a commodity code '0001' was input, the label issuing unit B creates the dot data, as shown in the figure on the right of FIG. 13. In other words, the label issuing unit B moves the print items succeeding the commodity name up into the two lines of "commodity name", and further, moves the "seller name" which is after the "additives" up into the three lines of "additives". The two lines of the "commodity name" and three lines of the "additives" shorten the label length data of the label format data retrieved.

Further, FIG. 14(*a*) and FIG. 14(*b*) show a case where the label length changes; and this case will be explained using a more specific example. In either case the "commodity name" is "Tempura Combo Platter", however from difference in the number of items in the platter, in the example shown the amount of data in the "additives" section are different. In FIG. 14(*a*) the amount of data for the print item "additives" is three (3) lines, and in FIG. 14(*b*) it is six (6) lines, and for example using the format for format number '#1' shown in FIG. 13, and thus in FIG. 14(*a*) the label has a surplus of two (2) lines from the "commodity name" section and one (1) line from the "additives" section and is therefore shortened by a total of three (3) lines and printed. Accordingly, a label printed with format number '#1' selected is shorter by three (3) lines. Then, the label length for a standard label is set at the format number '#1' and as aforementioned, given that the height of a single character, and the length between single lines are given, the length of the label is known if the label length is shortened by a length of three lines, and the label length of a dispensed label can be calculated on the basis of the label length set in the format retrieved.

In FIG. 14(*b*) the label has a surplus of two (2) lines from the "commodity name" section and an overage of two (2) lines in the "additives" section; consequently, the surplus portion and the overage portion cancel each other out and thereby the printed label will have a length of substantially the same length as the label length set at format number '#1'.

Figure 12:
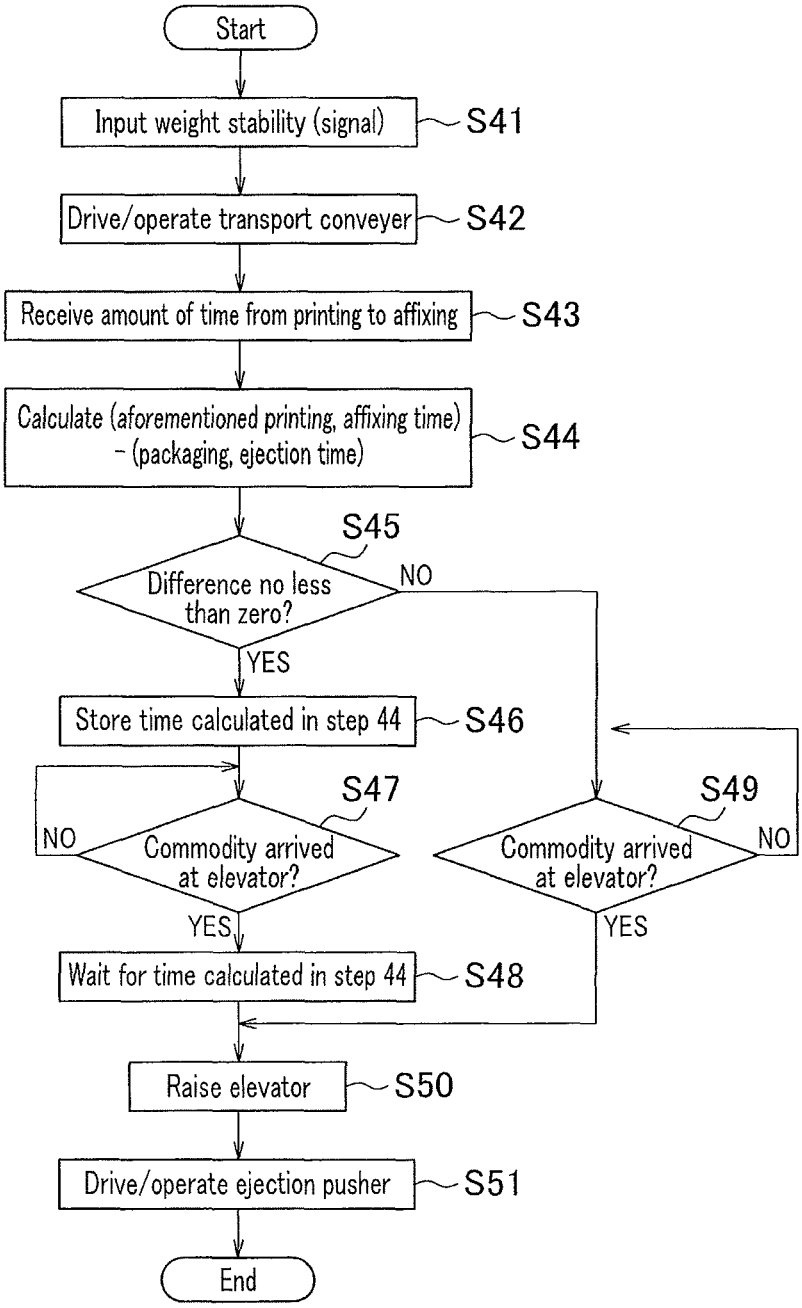
FIG. 12 is a flowchart for explaining the packaging operation of a packaging machine according to an embodiment of the present invention.

FIG. 12 is a flowchart showing the packaging operation of a stretch film packaging machine packaging the goods to be packed G. The CPU 58 controls each step shown in FIG. 12.

Step S41. The goods to be packaged G are placed on the weighing unit 15 of the commodity stage 13, and a weight stability signal is input once the weight reading stabilizes.

Step S42. The pusher type conveyer 1 operates and transports the goods to be packaged G currently on the commodity stage 13 towards the elevator 2.

Step S43. The CPU 58 receives a signal indicating the amount of time from the label to be affixed to the goods to be packaged G is printed until the label is affixed (the printing and affixing time).

Step S44. The timer comparator calculates the difference between the aforementioned time received and the amount of time from the goods to be packaged G is packaged and ejected (the packaging and ejecting time).

The amount of time it takes for goods to be packaged G to be wrapped in a film and for the resulting packaged goods G' to be ejected to the ejection path (heat seal unit) 10 are definite given that the speed of the elevator 2 and the speed of the pusher type ejector are constant, and that the moving distance thereof is known at the time the packaging machine is constructed.

Step S45. It is determined whether the above mentioned calculated time difference is greater than or equal to zero.

Step S46. If the calculated difference is determined to be greater than or equal to zero, the calculated time difference is recorded.

Step S47. The elevator sensor 17*c* located at the lowest position of the elevator in the vicinity thereof determines whether or not the goods to be packaged G transported in step S42 is sitting on the elevator 2. If the goods to be packaged G are not sitting on the elevator 2, the elevator sensor repeats the determinations until it is confirmed that the goods to be packaged G are sitting on the elevator.

Step S48. The goods the be packaged G are sitting on the elevator, and given that the time difference was stored in step S46, the CPU 58 delays the ascent of the elevator 2 by the amount of time of the stored time difference.

Step S49. If it was determined in step S45 that the time difference is less than zero (NO), the elevator sensor 17*c* determines whether or not the goods to be packaged G are sitting on the elevator 2. If the goods to be packaged G are not sitting on the elevator 2 (NO), the elevator sensor 17*c* repeats the determinations until it is confirmed that the goods to be packaged are sitting on the elevator. If the goods to be packaged G are sitting on the elevator 2 (YES), processing continues to step S50.

Step S50. The elevator 2 ascends oriented towards the packaging unit and packaging begins. As the packaging procedure, ascent of the elevator results in a film stretched tightly across the packaging unit covering the top surface of the goods to be packaged G, and the outer periphery end parts of the film are folded and tucked under the underside surface side goods to be packaged by the operation of a left-right tucking plate and a rearward tucking plate.

Step S51. The CPU 58 controls the driving of the pusher type ejector to so that the goods to be packaged G is pushed out oriented towards the ejection path, the remaining front side end part of the film is folded and tucked under the underside surface of goods to be packaged G and packaging is complete. Further, the packaged goods G' ejected to the ejection path has the overlapping and meeting end parts of the film tucked thereunder heated by a heater at the ejection path, and has the overlapping and meeting end parts of the film are thereby heat sealed.

Consequently, when a linerless label with a long label length is dispensed by a label issuing unit B using a linerless label roll L", packaging is completed, and even when the packaged goods (the article to be labeled) G' passing under the label suction unit (affixing unit) C1 cannot come in contact with the packaged goods G' until the packaged goods pass the ejection path (heat seal unit) 10 of FIG. 1 which is directly under the label suction unit (affixing unit) C1, by delaying the ascent time of the elevator 2, the printing and affixing time of the label is made to be in time for the packaging and ejection of the packaged goods G', and thereby the even a label with a longer label length can be affixed to the packaged goods.

In addition, the example explained illustrates that at step S48, the ascent of the elevator is delayed by just the time difference calculated in step S44, however, the delay need not always be limited to just the time difference, and the ascent of the elevator may be delayed by a time slightly greater than the time difference. In this case, the affixing unit suctions the label and remains in standby above the location the packaged goods G' will pass; and the affixing unit begins to descend at a given time after the commodity detecting sensor 57 detects the leading edge of the packaged goods G'.

Furthermore, although in the above described embodiment an example of changing the timing for the ascent of the elevator is illustrated, other examples for instance, changing the speed of the packaging process, in other words, changing the speed of the left-right tucking members 7, 7', the rearward tucking member 6, or driving speed of the pusher type ejector 8 in order to delay the time until packaging is complete may also be considered. However, changing the timing of the elevator ascent as described above without changing the driving speed of each tucking member will have less effect on the packaging process and therefore may be more preferable.

Next, pulling out a linerless label sheet L' from a linerless label roll L", when cutting and forming an individual linerless label of a prescribed length L, by controlling the operation of the cutter (label cutter) 69 to operate at a time the label affixer C received the linerless label dispensed by the label issuing unit B, a linerless label L can be affixed to an article to be labeled in the correct position and orientation. Below, a label affixing method and embodiments thereof are explained with reference to the drawings.

The method of affixing a label having the following steps of using a linerless label roll L" having one surface which is a print surface and another surface which is an affixing surface possessing an adhesive layer, pulling out a label sheet L' from the linerless label roll L", cutting the label sheet L' into an individual linerless label L of prescribed length, and affixing the cut linerless label L to an article to be labeled by a label affixer C, wherein a label sheet L' is pulled off from the linerless label roll L" and the cutter (label cutter) 69 which cuts the label sheet L' into an individual linerless label L of prescribed length is controlled to operate at any of: the time the label suction unit (affixing unit) C1 of the label affixer C comes in proximity to the dispensed linerless label L, or the time the label suction unit (affixing unit) C1 of the label affixer C holds the dispensed linerless label L, or the time after the label suction unit (affixing unit) C1 of the label affixer C holds the dispensed linerless label L. Specifically, one of three types of operation times is selected and set in the controller, and the cutter (label cutter) 69 then operates at the configured operation time.

The label affixer C may be of the push type that suctions the linerless label L dispensed by the label dispensing outlet (holder) 16 with the label suction unit (affixing unit) C1 of the label affixer C, and affixes the label L by pushing the label suction unit (affixing unit) C1 onto the article be labeled, or, the brush type that transports the linerless label L dispensed by the label dispensing outlet (holder) 16 with a conveyor (for example, a belt conveyor), and affixes the label to an article to be labeled using a brushing roller arranged downstream of the conveyor.

Accordingly, in the case the label affixer is for example a label affixer C having a the label suction unit (affixing unit) C1, the time the cutter (label cutter) 69 which cuts and forms the linerless label is operated, is controlled to be a timing when the label suction unit (affixing unit) C1 can suction the linerless label L dispensed from the label issuing unit B.

The timing at which the label suction unit (affixing unit) C1 is able to suction the linerless label L dispensed from the label issuing unit B may be:

(1) the time the label suction unit (affixing unit) C1 of the label affixer C comes in proximity to the dispensed linerless label L;

(2) the time the label suction unit (affixing unit) C1 of the label affixer C suctions the dispensed linerless label L;

(3) the time after the label suction unit (affixing unit) C1 of the label affixer C suctions the dispensed linerless label L.

In addition, the setting of the timing of the operation of the cutter (label cutter) 69 is selected and configured on considering the stiffness of the paper used for the linerless label sheet L', and the label length of the linerless label L that will be cut and dispensed.

The aforementioned timing (1), that is the time the label suction unit (affixing unit) C1 of the label affixer C comes in proximity to the dispensed linerless label L means the time just before the label suction unit (affixing unit) C1 comes into contact with the linerless label. In other words, this means although the label suction unit (affixing unit) C1 is apart (not in contact with) from the linerless label, the linerless label is within a distance such that it is affected by the suction force of the label suction unit (affixing unit) C1. Said yet another way, the timing at which, a little after a linerless label sheet L' is cut into a linerless label L of prescribed length, the label suction unit (affixing unit) C1 in proximity to the cut linerless label L, suctions the linerless label L.

Further, the aforementioned timing (2), that is the time the label suction unit (affixing unit) C1 of the label affixer C suctions the dispensed linerless label L, means the timing that the cutting of the linerless label sheet L' into a linerless label L of prescribed length and the suctioning of the cut linerless label L by the label suction unit (affixing unit) C1 is performed at substantially the same time.

Finally, the aforementioned timing (3), that is the time after the label suction unit (affixing unit) C1 of the label affixer C suctions the dispensed linerless label L, means the timing after the dispensed linerless label sheet L' is suctioned by the label suction unit (affixing unit) C1 the linerless label sheet L' is cut.

By selecting one configuration from (1) through (3), the cutter (label cutter) 69 cuts the linerless label sheet L' at the timing at which the label suction unit (affixing unit) C1 of the label affixer C arrives at the cut and dispensed linerless label L or, possibly, the timing at which the label suction unit (affixing unit) C1 of the label affixer C suctions the linerless label L, and therefore the cut linerless label L is suctioned by the label suctioning unit (affixing unit) C1 at the moment the cutting of the linerless label sheet L' is complete or just after cutting of the linerless label sheet L' is complete, and thereby the flying off of the linerless label L resulting from the impact of or as a reaction to the separation of the cutter (label cutter) 69 is prevented. Hence, the label suction unit (affixing unit) C1 of the label affixer C can hold the post-cut linerless label L in a correct position and affix the linerless label L at the correct position in the correct orientation.

In addition, the aforementioned timing configuration may be made adjustable in relation to the label length of a cut and formed individual linerless label.

The Second Embodiment

Next, an embodiment of a label affixing device using the aforementioned label affixing method will be explained based on the drawings.

Moreover, structural elements similar to those detailed in the previously illustrated embodiment are given the same reference numbers and a detailed explanation will be omitted.

Figure 15:
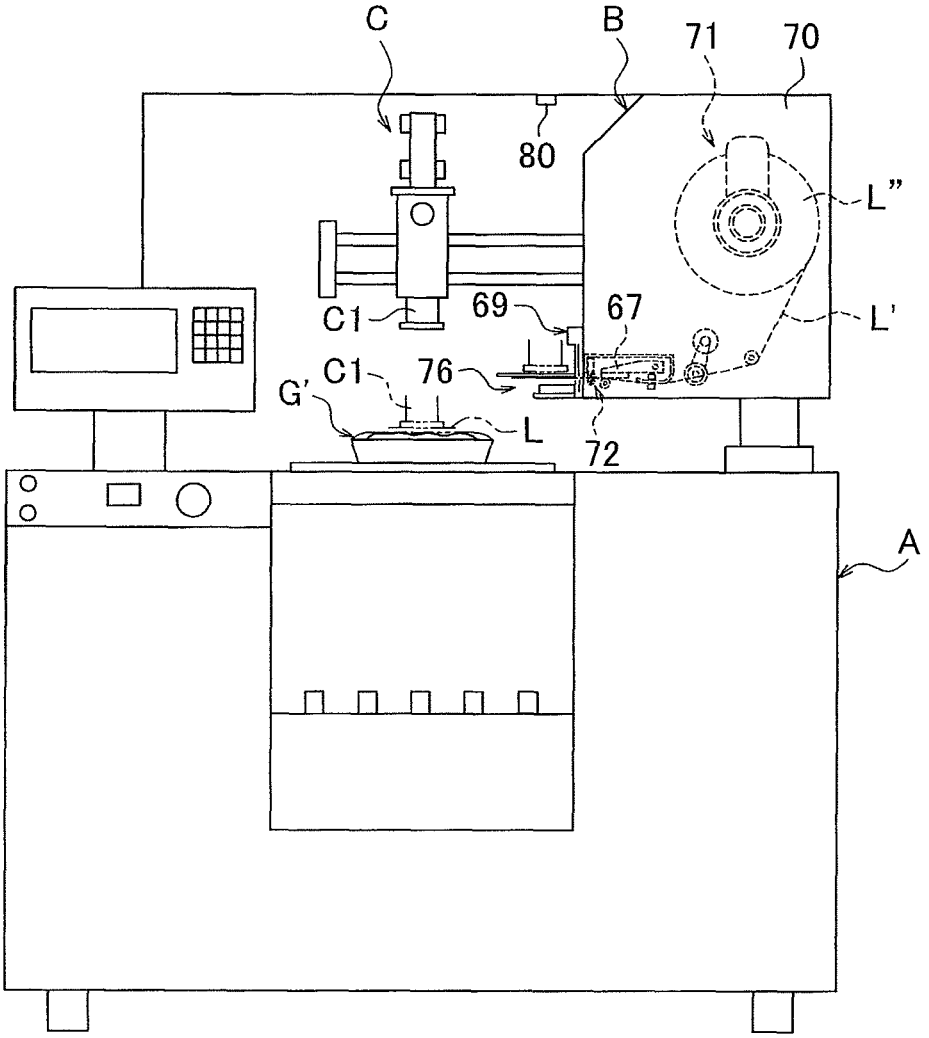
FIG. 15 is a front view showing an outline of a packaging device assembled with a label affixing device according to an embodiment of the present invention.

FIG. 15 shows the front view of a stretch film packaging machine combined with a label affixing device provided with a linerless label issuing unit B and a label affixer C that affixes a linerless label L dispensed from the linerless label issuing unit B to packaged goods G' (an article to be labeled). Within the figure, once the stretch film packaging machine receives the goods to be packaged G, the goods to be packaged G are automatically wrapped in stretch film, and the already wrapped packaged goods G' (an article to be labeled) are ejected on an ejection path. Arranged near the ejection path of the stretch film packaging machine A where the packaged goods G' are ejected is a label affixing device which is provided with a label issuing unit (printer) B and a label affixer C and which is configured to affix a linerless label L to the already wrapped packaged goods G' (the article to be labeled)

The stretch film packaging machine A transports the goods to be packaged G via a transport conveyor to an elevator arranged directly beneath the packaging unit. The goods to be packaged G, by ascent of the elevator pushes up from the bottom of a film stretched tightly across the packaging unit thereby covering the top surface of the goods to be packaged G. Further, the outer edges of the film are folded and tucked underneath the goods to be packaged G by tucking plates and tucking rollers and so forth; the overlapping and meeting portions of film folded and tucked underneath the goods to be packaged are heat sealed and packaging is complete. This describes the heretofore known push up type packaging device for a packaging machine. Given the machine has no direct relation with the label affixing device according to embodiments of the present invention, a detailed explanation will be omitted. Below the label affixing device is explained with reference to the drawings.

Figure 16:
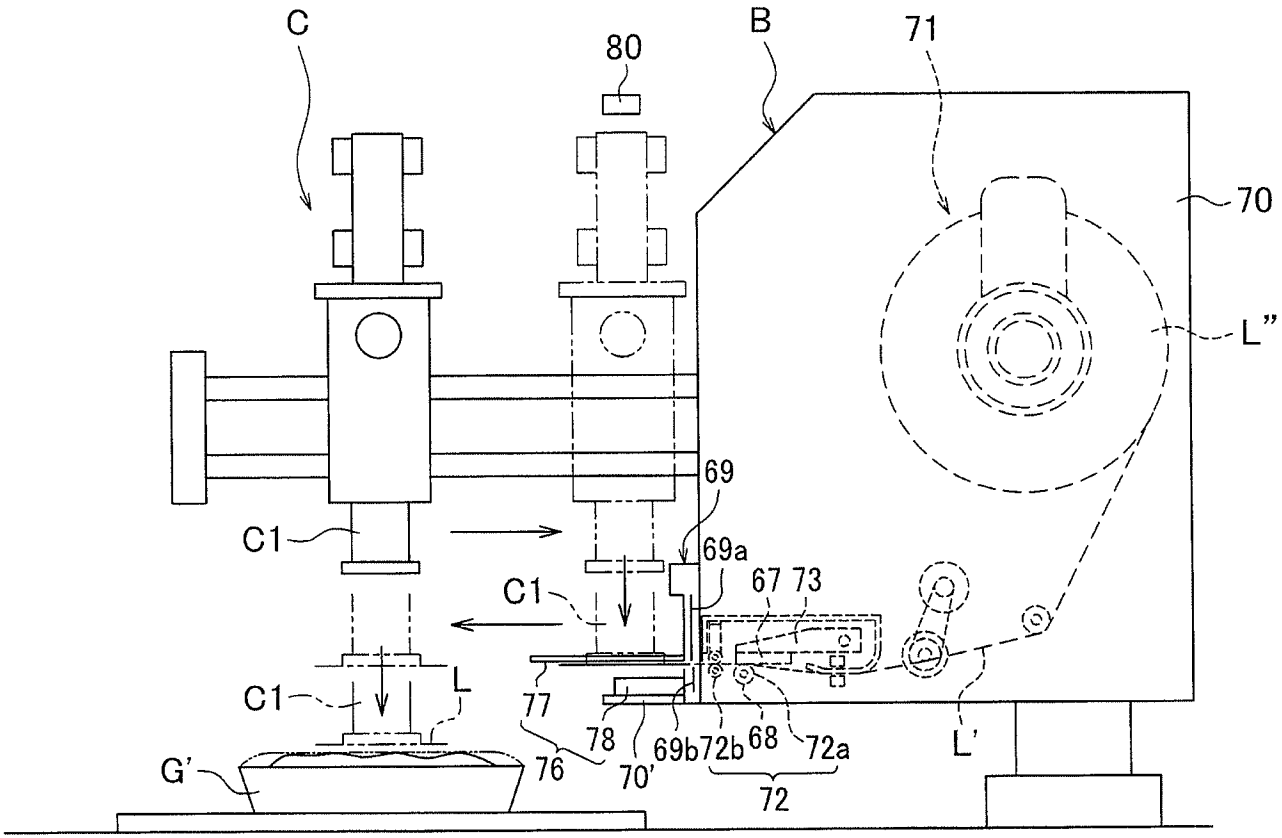
FIG. 16 is an enlarged front view of a label affixing device according to an embodiment of the present invention.

The label issuing unit (printer) B is a linerless label printer using a linerless label roll L" composed of an elongated shaped linerless label sheet L' having one surface which is a print surface and another surface which is an affixing surface possessing an adhesive layer and wound into a roll. As shown in FIG. 16, a roll loading unit 71 is provided inside a case 70, and in front of the extension direction of the label sheet L' on the linerless label roll L" set on the roll loading unit 71 are arranged a label feeder 72, a printer unit 73, and a cutter (label cutter) 69 that cuts a prescribed length of a linerless printed label sheet L'. The roll loading unit 71 is supported so that the linerless label roll L" can rotate.

The label feeder 72 which dispenses a linerless label sheet L' from the linerless label roller L" is comprised of a sheet label feeder 72*a*, and a sheet label feeder 72*b*. The sheet label feeder 72*b* is comprised of a top and bottom pair of rollers arranged upstream near the label dispensing outlet 74 provided in a peripheral wall of the case 70. The sheet label feeder 72*a* also used by the print unit 73 is arranged further upstream and separated from the sheet label feeder 72*b* by a given amount of space.

The upstream sheet label feeder 72*a* which is also used by the print unit 73 consists of a platen roller 68 positioned at the lower region (the affixing surface side) of the label sheet L', and a thermal head 67 positioned at the upper region (the print surface side) of the label sheet L'. The platen roller 68 and the lower side roller of the downstream sheet label feeder 72*b* are driven and rotated by a motor. The label sheet L' is urged so as downward so as to be sandwiched and held between the roller on the lower side of the label sheet L' (platen roller 68) and the thermal head 67 positioned at the upper region of the label sheet L' and the upper side roller of the downstream sheet label feeder 72*b* respectively; thereby the construction is such that the label sheet L' is stable and can be dispensed.

Further, the front surface of the platen roller 68 of the print unit 73 and the lower roller of the downstream sheet label feeder 72*b* are respectively coated with a separating agent, so that each part does not stick to the adhesive agent applied to the surface opposite the print surface of the label sheet L'. Thereby the label sheet L' can be smoothly dispensed. Moreover, the adhesive layer of the label sheet L' is not limited to being configured to not stick to the roller, the roller may be constructed such that the roller itself or the outermost perimeter portions of the roller are made from components easily separable from the adhesive layer of the label sheet.

Figure 17B:
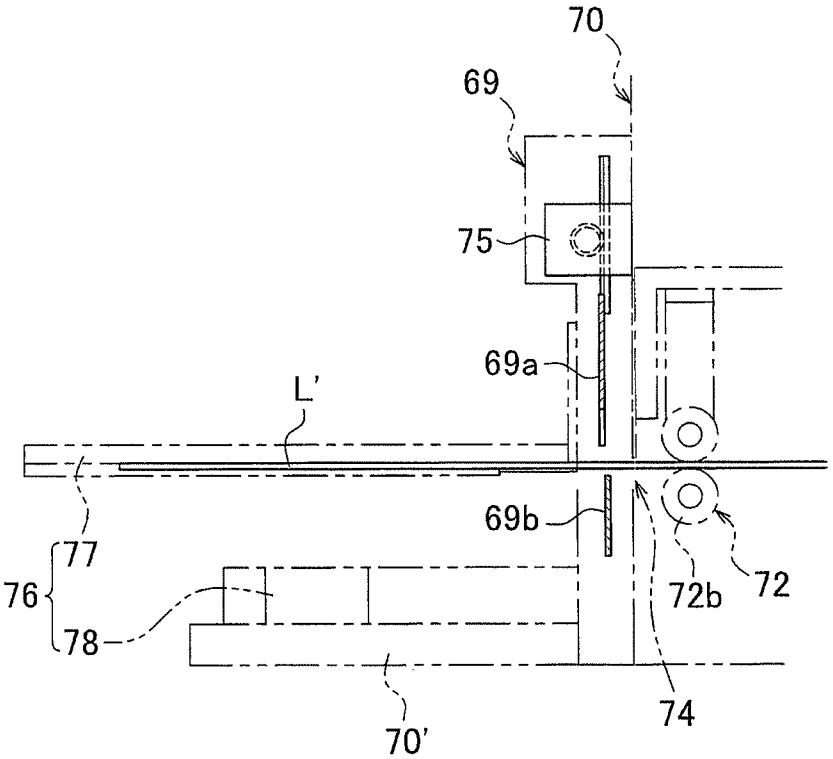
FIG. 17 (*a*) is a side view showing the label cutter of a label issuing unit according to an embodiment of the present invention.
Figure 17A:
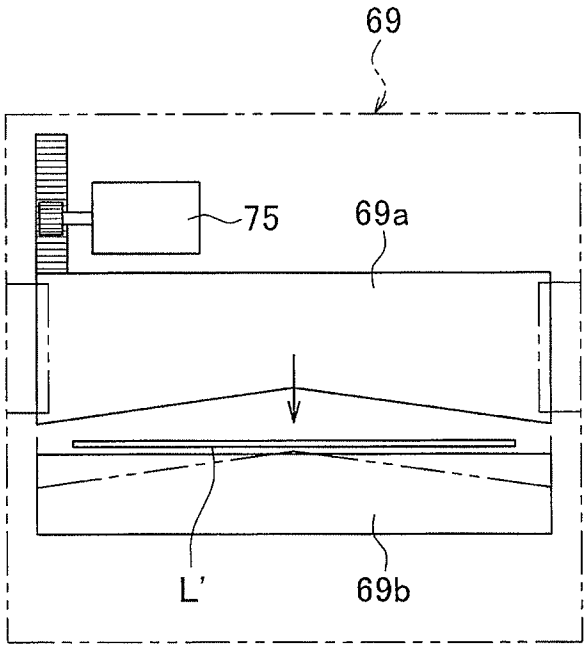
Figure 18A:
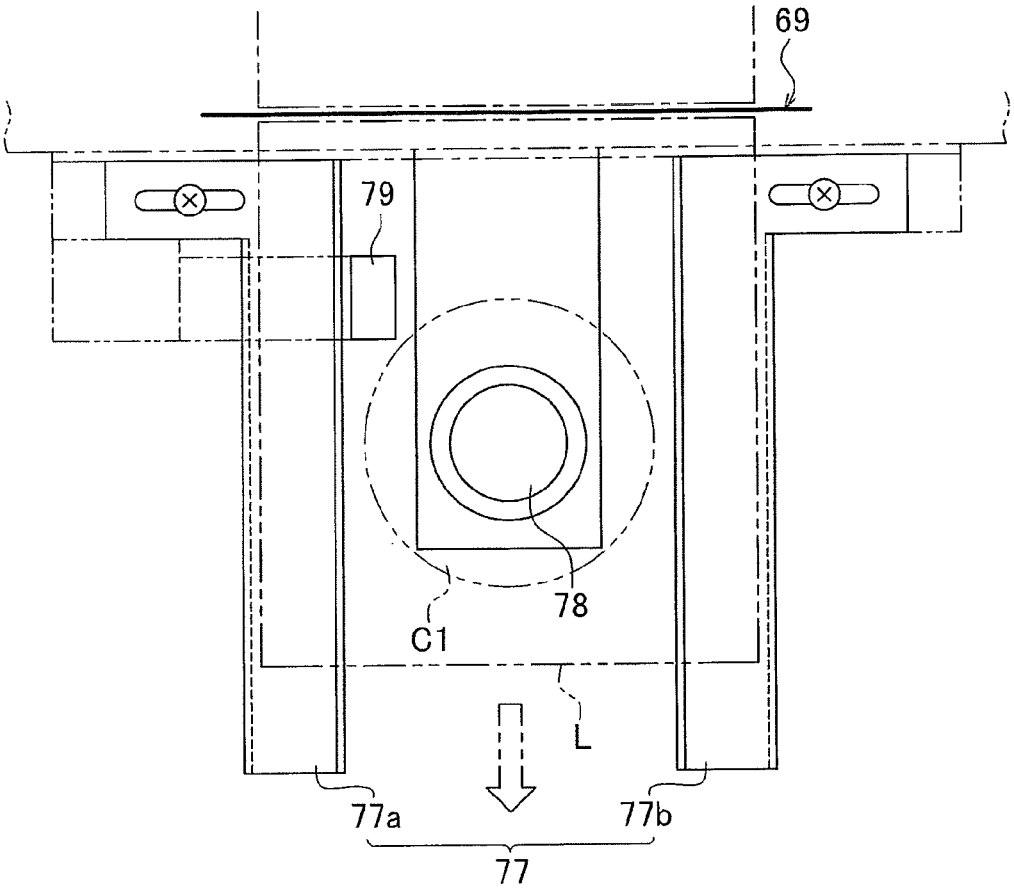
FIG. 18 (*a*) is a top plan view showing the holder of a label issuing unit according to an embodiment of the present invention.
Figure 18B:
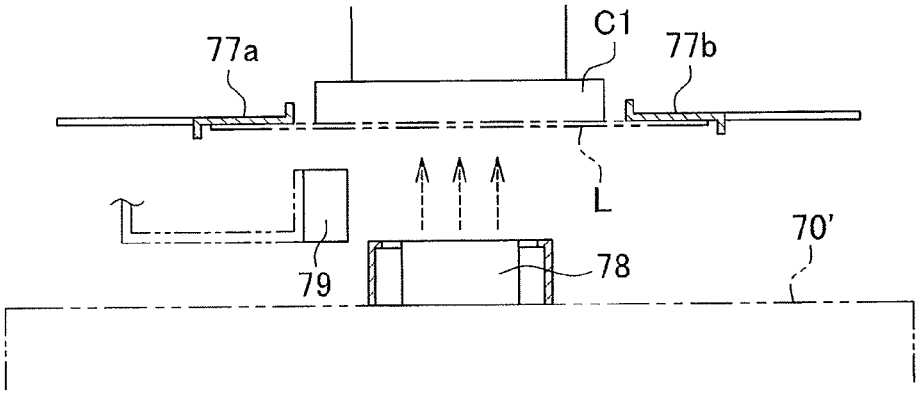
Figure 19:
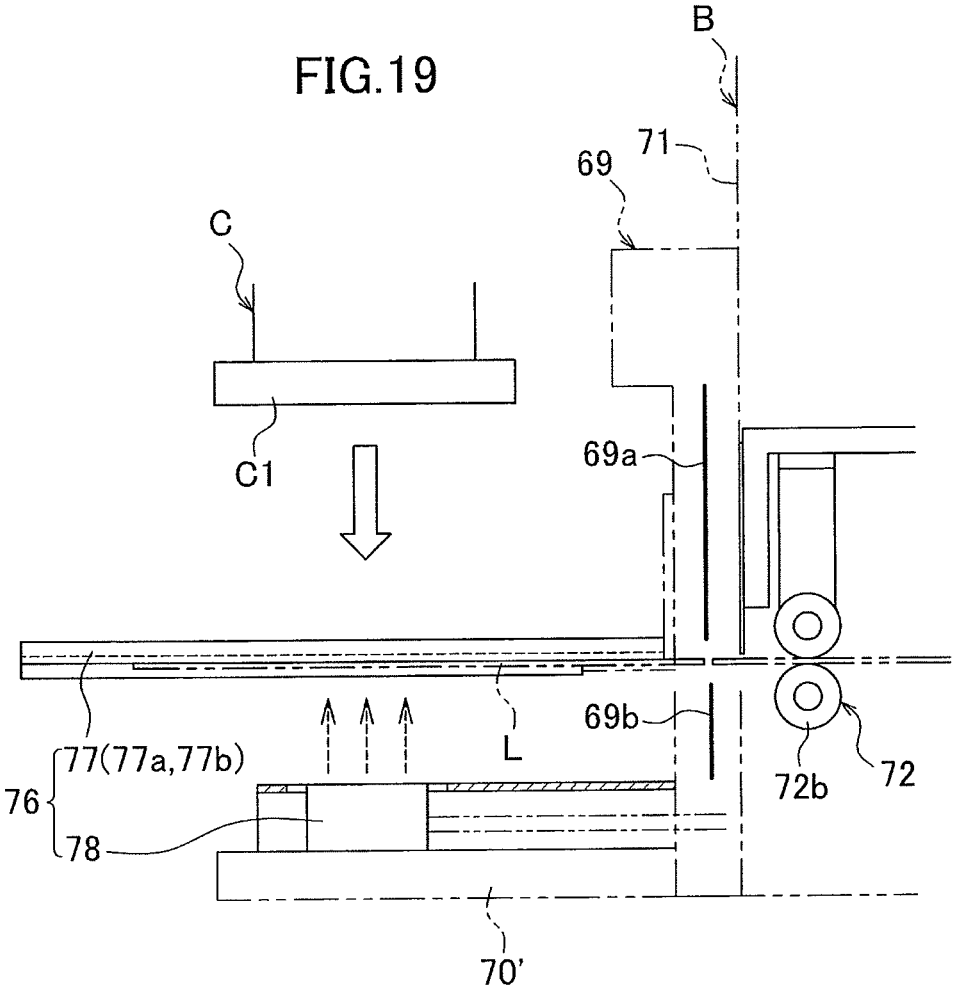
FIG. 19 is a partial longitudinal cross-section view showing the relative relationship between the label issuing unit and the label affixer.

A label sheet L' having commodity information printed thereon at the printer unit 73 is dispensed oriented towards the label dispensing outlet 74; the cutter (label cutter) 69 that cuts the label sheet L' into an individual label of a prescribed size consists of as shown in FIG. 17, a top and bottom pair of a movable blade 69*a* and a fixed blade 69*b* arranged so as sandwich the label sheet L' horizontally dispensed from the label dispensing outlet 74.

The blade part of the movable blade 69*a* arranged on the print surface side (the upper side) of the label sheet L' is formed as an upside down V shape, and the blade part of the fixed blade 69*b* arranged on the affixing surface side (the lower side) of the label sheet L' is formed as a band type blade having a constant width. The label sheet L' is cut by a shearing action resulting from movement of the movable blade 69*a* towards the fixed blade 69*b*.

The movable blade 69*a* is configured to move back and forth by means of a motor 75. Further, by forming the blade part of the movable blade 69*a* into an upside down V shape, given that the cutting of the label sheet L' proceeds from both sides in the width direction towards the center, the center portion is cut last when the linerless label L is cut and separated, and compared to a method of cutting the entire width all at once, the possibility of the linerless label L flying off or becoming skewed is reduced.

Further, a holder 76 provided downstream of the cutter (label cutter) 69 holds the linerless label L cut into an individual label by the cutter (label cutter) 69 until the label suction unit (affixing unit) C1 of the label affixer C arrives to suction the linerless label L.

The holder 76 is provided with a label holding body (receiver) 77 that holds the linerless label L cut by and dispensed from the cutter (label cutter) 69 in a substantially horizontal position, and an air diffuser 78 that causes the dispensed linerless label L to come into contact with the lower surface of the label holding body 77.

The label holding body 77 protrudes along the transport direction of the linerless label L cut and dispensed by the cutter (label cutter) 69, and is provided with a pair of parallel frames 77*a*, 77*b* arranged opposing each other and spaced apart in the label width direction which intersects the transport direction of the linerless label L; the pair of parallel frames 77*a*, 77*b* are mounted so as the expand and retract and thereby the space therebetween is adjusted in relation to the width dimension of the linerless label L.

An air diffuser 78 causes the surface opposite to the affixing surface (the print surface) of dispensed and transported linerless label L to come into contact with the lower surface of the pair of parallel frames 77*a*, 77*b*; the air diffuser blows air onto the affixing surface (the lower surface) of the linerless label L from beneath, pushing the linerless label L upward, making in contact with the pair of parallel frames 77*a*, 77*b*, and may be comprised of, for instance, a small air blower fan.

The air diffuser 78 is placed and fixed on the top surface of a protruding part of the bottom plate 70' within the case 70 of the label issuing unit B, therefore, even if the label issuing unit B switches the label affixer C from an automatic affixing state (see FIG. 15), to an manual affixing state where the label affixer C rotates anticlockwise horizontally by 90 degrees, changing the dispensed linerless label L transport direction to same direction as the ejection direction of the packaged commodity of the stretch film packaging machine A, the dispensed linerless label L will reliably be in contact with and held at bottom surface of the label holding body 77. The air blower fan provided in the air diffuser unit 78 is arranged substantially at the center section between the pair of holding frames 77*a*, 77*b*, and the diffused air comes in contact at substantially the center section of the linerless label L, pushing the linerless label up substantially vertically.

Further, in the vicinity of the air diffuser 78 a sensor 79 is arranged which detects whether or not a linerless label L is present on the label holding body 77, whereby dispensing of a linerless label L is controlled by the detection signal from the sensor 79.

Furthermore, the structure of the air diffuser 78 need not be limited to an air blower fan placed on the bottom plate 70'. The source of diffusing air may be arranged at other locations, or may be a configuration where a hose is connected to an air generator.

The label affixer C may be a typical construction with a label suction unit (label applicator or affixing unit) C1 that suctions and holds a lineless label L held at the label holding body 77, and a conveyor (for example the conveyor C2 and so forth illustrated in the previous example) that moves the label suction unit (affixing unit) C1 from its initial position to substantially directly below the label holding body 77 and further from the position of the label holding body 77 to the position of the already wrapped packaged goods G' (the article to be labeled) to be affixed with the linerless label L. The label suction unit (affixing unit) C1 that suctions and holds a linerless label L is constructed so that a suction force is generated by the negative pressure at a label suction surface generated by means of the rotation of a suction fan. The suction fan may be constructed to operate ON and OFF at the same time as the air blower fan 78 of the holder 76.

Further, the label suction unit (affixing unit) C1 is moved to a position directly above the label holding body 77 in order to suction and hold a linerless label L held at the label holding body 77 of the label holding body 77 and a sensor (detector) 80 detects whether or not the label suction unit (affixing unit) C1 is directly above the label holding body 77.

As shown in FIG. 3 which shows the block diagram of a device wherein the stretch film packaging machine A illustrated has installed a label issuing unit B and a label affixer C. The device is provided with a label issuing unit controller D which controls the label issuing unit (printer) B and a packaging machine control unit E.

The label issuing unit controller D controls primarily the functions related to the label issuing unit B, operates according to prescribed programs stored in a ROM 42 while each component thereof is controlled by a CPU 41. The label issuing unit controller D is further provided with a RAM 43 which stores various settings temporally, a display operation unit 44, a weighing unit 45, a thermal head 67, a stepping motor 48 that drives the platen roller 68, a cutter (label cutter) 69 that cuts a linerless label sheet L' printed on by the thermal head in prescribed length, a cutter driving motor 49 that drives the cutter (label cutter) 69, a driving circuit 50 for horizontal motor M1 which causes the label suction unit C1 to move, a horizontal standard position sensor F1 (51), an up-down motor M2 driving circuit 52, an up-down standard position sensor F2 (53), a rotation motor M3 driving circuit 54, a rotation standard position sensor F3 (55), a label affixing contact sensor F4 (56), and a commodity detecting sensor 57. Each component is connected to a bus 41*a* and through an interface circuit for communication (INF) 46 is connected to the stretch film packaging machine A, and the label issuing unit controller receives a signal indicating that the packaged goods G' (an article to be labeled) has reached the label affixing position and issues a linerless label L. Furthermore, the commodity detecting sensor 57 is provided for the purpose of generating a label affixing signal, whereby when a commodity is positioned at the label affixing location, the commodity detecting sensor outputs a signal to the CPU 41.

Finally, in the ROM 42 is stored the configuration settings for the timing for operating the cutter (label cutter) 69 whereby the optimal operation timing of the label cutter is set in relation to the properties such as the longness or shortness of the label length, the thickness (stiffness) of the paper (strength), and so forth, of the linerless label L.

The packaging machine control unit E controls primarily the components of the stretch film packaging machine A and is controlled by means of CPU 58 to which is connected via a bus 58*a* a communication interface circuit (INF) 59, a ROM 60, a RAM 61, an operation unit 62, and a machine driving unit 63.

The machine driving unit 63 is a circuit for the purpose of driving each component of the packaging machine during packaging; specifically, to the machine driving unit 63 is connected a transport motor 65 that drives the transporting conveyor transporting the goods to be packaged G, a motor 64 that drives the elevator 2, a film transfer motor 66 that drives the film feeder, a tucking motor that drives the tucking plates which tuck and fold a film covering the goods to be packaged G under the underside surface of the goods to be packaged G, a pusher type motor that drives the pusher type ejector, and so forth.

The ROM 42 may have set and stored the configuration settings for the timing for operating for the cutter (label cutter) 69, that is Timing (1) the time the label suction unit (affixing unit) C1 of the label affixer C comes in proximity to the dispensed linerless label L;

Timing (2) the time the label suction unit (affixing unit) C1 of the label affixer C suctions the dispensed linerless label L; and Timing (3) the time after the label suction unit (affixing unit) C1 of the label affixer C suctions the dispensed linerless label L.

Further, the relationship between the type of linerless label L and the timings for operation of the cutter (label cutter) 69 are as follows.

1. Timing (1) is for a label of normal size (40 mm×60 mm), and can be suitable when there will be little effect from the cutting force of the cutter (label cutter) 69 and the reaction of the linerless label when cut and separated from the cutter. This timing can be effective when there is a need to speed up the affixing cycle for a label.

2. Timing (2) is suitable for a label that is shorter in the transporting direction than a label of normal size (40 mm×60 mm), and in the case of the shorter label, the air pressure from the air diffuser 78 in the label holder 76 may change the position and orientation of the label, or there is a possibility that the post-cut linerless label cannot be held because of an adjustment of the position of the label holder 76, however, the post-cut linerless label can be suctioned beforehand. In addition, similarly, if the paper of the linerless label is thin (the paper is soft), the air pressure from the air diffuser 78 in the holder 76 may change the position and orientation of the post-cut label, however the label can be suctioned before a change in the position or orientation, and therefore this timing is suitable.

3. Given that, in the case the paper for a label is thick, there is a high possibility that the post-cut label will shift about, with Timing (3), the cutter (label cutter) 69 cuts an individual label from the linerless label sheet in a state where the linerless label sheet is suctioned and held by the label suction unit (affixing unit) C1 of the label affixer C (so that the linerless label sheet is fixed), thereby making the Timing (3) suitable for suppressing (reducing) the effect of the cutting force of the cutter (label cutter) 69 and the reaction of the linerless label when cut and separated from the cutter. Moreover, given that the above phenomenon appears prominently when the label size is small, the Timing (3) may also be suitable for labels that are shorter than the normal size label (40 mm×60 mm) in the transport direction. Further, for the shorter label, even if the holding position of the label holder 76 is not adjusted, the cutter (label cutter) 69 cuts the linerless label sheet into an individual linerless label in the state that the label suction unit (affixing unit) C1 of the label affixer C suctions and holds the linerless label sheet, and therefore even in the case the label holder 76 cannot hold the post-cut linerless label, before a short linerless label is cut off from the linerless label sheet, the label suction unit (affixing unit) C1 of the label affixer C suctions the short label portion with the linerless label sheet in the label sheet form beforehand, and then the cutter (label cutter) 69 cuts an individual label. Therefore, even though the holder does not hold the linerless label, the label suction unit (affixing unit) C1 of the label affixer C overcomes the problem of failing to affix the label to an article to be labeled.

Figure 20:
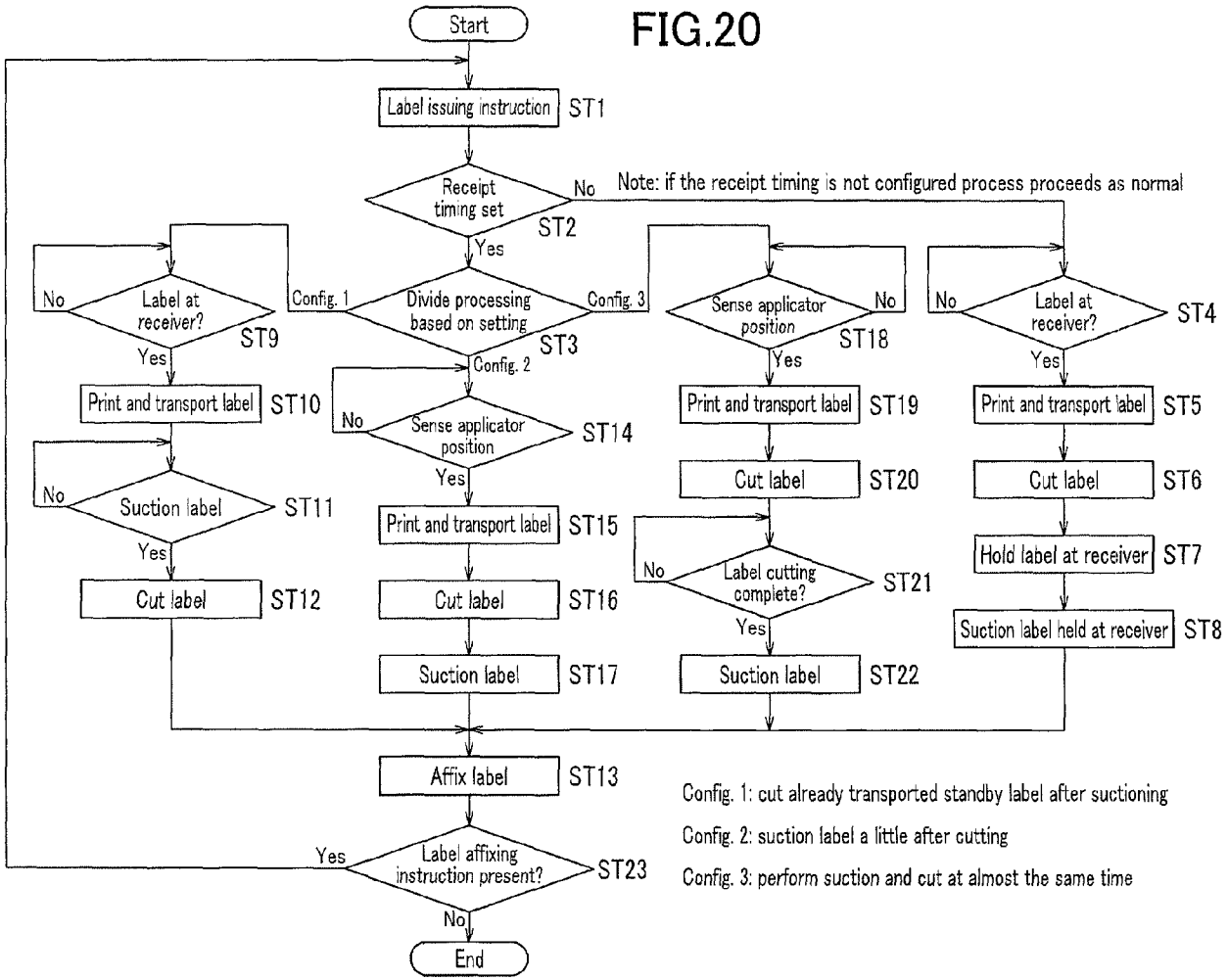
FIG. 20 is a flowchart diagram showing a linerless label affixing operation.

Next, the operation of the label affixing device is explained with reference to the flow chart in FIG. 20. Furthermore, the goods the be packaged G are transported into the stretch film packaging machine A, however given that the film packaging operation is not directly related to the present invention, the details thereof will be omitted.

Once the command is sent out to issue a label for goods to be packaged G wrapped by the stretch film packaging machine A (ST1), the label affixing device determines whether or not an operation timing (receiving timing) for the cutter (label cutter) 69 is configured (ST2), if an operation timing was configured, the process continues on to a given branch on the basis of the configuration setting (ST3), if an operation timing was not configured, a conventional operation (ST4→ST5→ST6→ST7→ST8) is executed and the label affixing device affixes a linerless label L to the already packaged goods (article to be labeled) G'.

Whereas, if the operation timing was configured, within the label affixing device a linerless label sheet is cut and a linerless label affixed on the basis of the selected operation timing.

Each operation time setting is explained below.

[Configuration 1] The Selection of Timing (3)

First, a sensor 79 detects whether or not a linerless label is absent at the label holder body (receiver) 77 of the holder (76) (ST9). If there is a linerless label L (NO), detection is repeated until no linerless label L is detected; and if there is no linerless label L (YES), the label feeder 72 and the printer unit 73 operate to print to and dispense the linerless label sheet L'

Figure 21A:
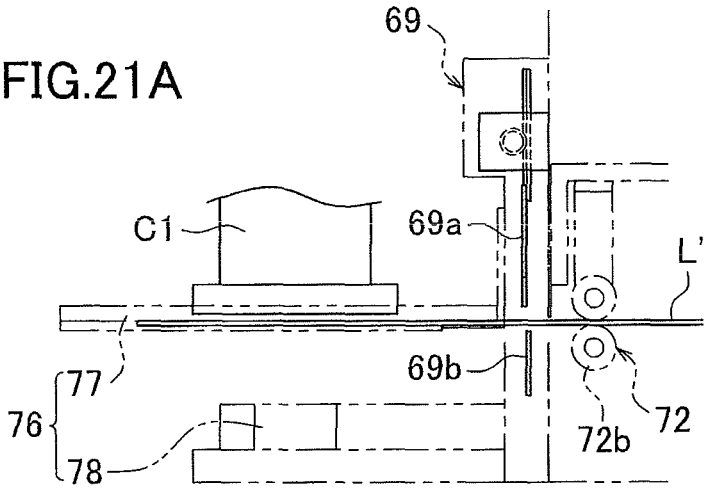
FIGS. 21(*a*) through 21(*c*) are explanatory diagrams showing the positional relationship between the label cutter and the label suctioning unit during each operation time (configuration 1, configuration 2, configuration 3) in the flowchart shown in FIG. 20.
Figure 21B:
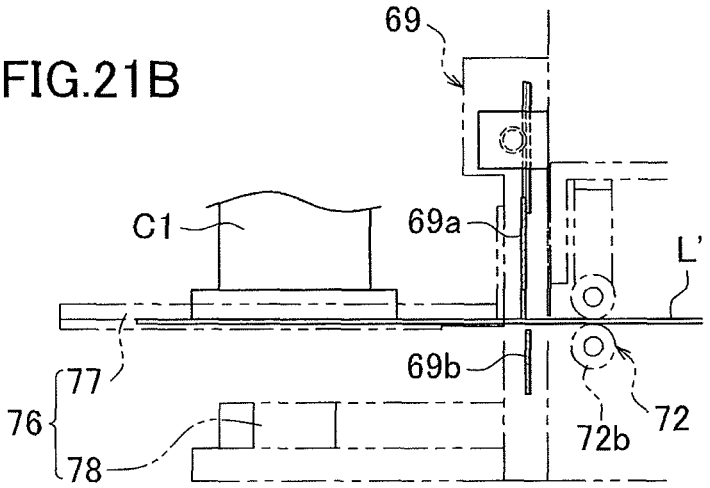
Figure 21C:
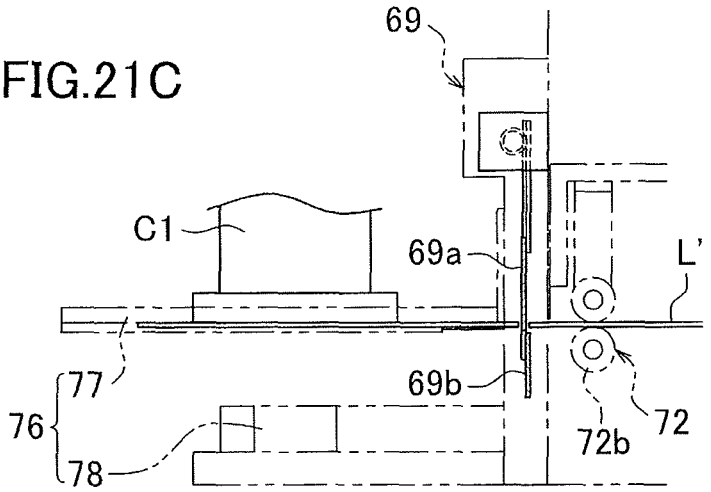
Figure 22A:
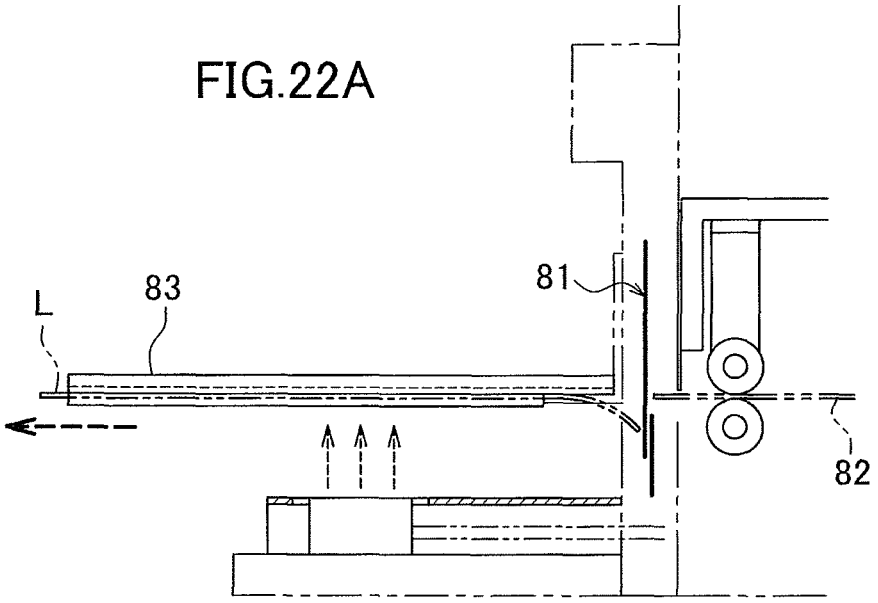
FIGS. 22(*a*) and 22(*b*) are explanatory diagrams showing a structure of the related art.
Figure 22B:
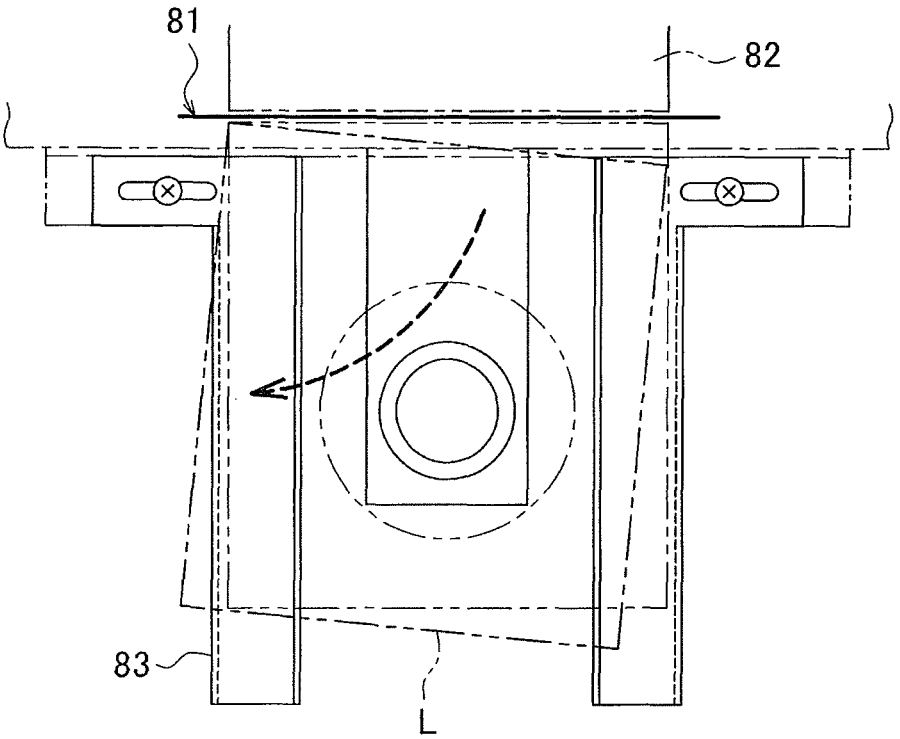

(ST10). It is determined whether or not the label suction unit (affixing unit) C1 of the label affixer C has suctioned the linerless label sheet L' dispensed from the label dispensing outlet 74 (ST11). If it is determined that the label suction unit (affixing unit) C1 of the label affixer C has not suctioned the linerless label sheet L' (NO), determinations are repeated until it is confirmed that the label suction unit (affixing unit) C1 of the label affixer C has suctioned a linerless label sheet L'; and if it is determined that the label suction unit (affixing unit) C1 of the label affixer C has suctioned the linerless label sheet L' (YES) the cutter (label cutter) 69 is operated, the linerless label sheet is thereby cut, and a linerless label L is formed (ST 12). Further, the label suction unit (affixing unit) C1 that suctioned the linerless label L moves horizontally to a position directly above the already wrapped packaged goods (article to be labeled) G', descends downward in a vertical direction, and affixes the linerless label L to the commodity (ST 13). (See FIG. 21 (*b*)).

[Configuration 2] The Selection of Timing (1)

A sensor (detector) 80 detects whether or not the label suction unit (label applicator or affixing unit) C1 of the label affixer C is positioned directly above the label holding body (receiver) 77 of the holder 76 (ST14). If it is determined that the label suction unit (affixing unit) C1 is not positioned directly above the label holding body (receiver) 77 (NO), detection is repeated until the label suction unit (affixing unit) C1 is positioned directly above the label holding body (receiver) 77; and if it is determined that the label suction unit (affixing unit) C1 is positioned directly above the label holding body (receiver) 77 (YES), the label feeder 72 and the printer unit 73 operate to print to and dispense the linerless label sheet L' (ST15); the cutter (label cutter) 69 is operated, the linerless label sheet L' is thereby cut, and a linerless label L is formed (ST 16). Further, the cut and dispensed linerless label L is held by the holder 76 at the label holding body 77, however immediately after cutting is complete the label suction unit (affixing unit) C1 descends and suctions the linerless label L (ST17), after which the label suction unit (affixing unit) C1 that suctioned the linerless label L moves horizontally to a position directly above the already wrapped packaged goods (article to be labeled) G', descends downward in a vertical direction, and affixes the linerless label L to the already wrapped packaged goods G' (ST 13). (See FIG. 21 (*a*)).

[Configuration 3] The Selection of Timing (2)

A sensor (detector) 80 detects whether or not the label suction unit (label applicator or affixing unit) C1 of the label affixer C is positioned directly above the label holding body (receiver) 77 of the holder 76 (ST18). If it is determined that the label suction unit (affixing unit) C1 is not positioned directly above the label holding body (receiver) 77 (NO), detection is repeated until the label suction unit (affixing unit) C1 is positioned directly above the label holding body (receiver) 77; and if it is determined that the label suction unit (affixing unit) C1 is positioned directly above the label holding body (receiver) 77 (YES) the label feeder 72 and the printer unit 73 operate to print to and dispense the linerless label sheet L' (ST19); the cutter (label cutter) 69 is operated, and cutting of the linerless label sheet L' commences (ST20), and it is determined whether or not the cutting operation is complete (ST 21). If the cutting operation is not complete (NO), determinations are repeated until it is confirmed that the cutting operation is complete; and if the cutting of the linerless label sheet L' is complete (YES), the label suction unit (affixing unit) C1 of the label affixer C descends and suctions the linerless label L at substantially the same time that the cutting operation is complete (ST22). Subsequently, the label suction unit (affixing unit) C1 that suctioned the linerless label L moves horizontally to a position directly above the already wrapped packaged goods (article to be labeled) G', descends downward in a vertical direction, and affixes the linerless label L to the already wrapped packaged goods G' (ST 13). (See FIG. 21 (*c*)).

Further, after the end of one label affixing operation, the label affixing device determines whether or not there is a command to affix a label (ST23), if there is another command to affix a label (YES), processing returns to step ST1 and the aforementioned operations are repeated. If there is no command to affix a label (NO), the label affixing operation ends.

Embodiments of the present invention provide a label affixing device whereby the timing for the operation of a cutter (label cutter) for cutting a linerless label sheet is selected and configured in relation to the type of linerless label (label length, label thickness and so forth) to be affixed to packaged goods (an article to be labeled). Thereby, the label affixing device according to embodiments of the invention, can prevent the skewing and flying off of the label in the feeding direction of the label that results from the impact force at the time of cutting by the cutter (label cutter), and the reaction of the cut and separated linerless label sheet, or the effect of the stickiness of the adhesive surface of the linerless label sheet, and so forth without being influenced by the thickness (stiffness) of the linerless label sheet, or the label size (the length in the transporting direction), and thereby, a cut and dispensed linerless label can be held at a suitable position by the label holding body of a holder. Accordingly, a label suction unit can suction the linerless label in the correct position and in the correct orientation, and can correctly affix the label to a prescribed position on a commodity. Consequently, the problems where the label juts out from the labeled article (packaged goods), or possibly the amount of blank space from between a prescribed location (for example, the bottom right corner on the front face of the article to be labeled) and the affixed position is not constant, and so forth, and the is a lack of uniformity between the affixed position and the position setting for the label, will not occur.

The present invention is not limited to the embodiments detailed herein; various changes and modifications may be made without departing from the spirit and scope of the invention. That is to say:

1. An example from the first embodiment illustrates the case where the print range was made smaller in relation to the print data for a given print item, for example "commodity name", "additives", and so forth; however there is no need to limit the present invention to this case. For instance, for each printing format represented in the print area, a "Change of Position Allowed" permission flag or "Change of Position Prohibited" prohibition flag may be provided, so that the label affixing device may shift the printing area and perform printing only when this permission flag is set in the printing format.

2. The first embodiment illustrates an example wherein succeeding print items are used to fill in a print area on the basis of the print data of a previously specified print item and the print area. However, without being limited by this case, for example, as discussed in Japanese Patent No. 2580967, within a dot image the number of lines of continuous blank dots may be counted, and the number of lines of blank dots may be reduced, thereby shortening the label length.

3. The first embodiment illustrates an example wherein the label length is shortened when the print data of a given print item does not fill the print area of the print item with respect to the sheet transporting direction. However, without being limited to this example, for instance, the print area of the print item may be expanded in the sheet transporting direction, so that the print data fills the print area in the sheet transporting direction, and by shifting the position of the succeeding print items, this method may be used in the present invention even when the label length becomes long.

4. In an example from the first embodiment, although as an example of the packaging machine, a packaging machine using an elevator push up type method is provided, wherein the ascent (driving) of the elevator used in packaging is modified with respect to the change in time from the printing and dispensing to the affixing of a label resulting from the difference in the length of the label length, so that even linerless labels having differing lengths can be affixed at the correct prescribed position, in other packaging methods, by adjusting the operation times of operating components involved in the packaging, the same effect can be achieved.

5. From the first embodiment, an example is provided wherein a label of certain length is used as the standard label length in a label format file, and with respect to the label format, the label length is determined based on the increase and/or decrease of the amount of print data, and the moving of the affixing unit is corrected by comparing the determined label length and the standard label length. However, without being limited to this case, for example, the moving distance of the affixing unit, the descent timing and so forth for each of a plurality of label lengths may be stored and configured in a table. Therefore from the table the label length most similar to the label length of an actual printed and dispensed label may be determined and the affixing unit may be moved on the basis of the moving distance and the descent time set in association with the determined label length.

6. From the first embodiment, an example is provided wherein a tray file is provided and for each tray the label affixing position is defined. However, without being limited to this case, for example, an affixing position condition (bottom right, top right, bottom left, top left; vertical, horizontal; distance from the edge of the tray (X0, Y0), and so forth) may be defined for a label; and each of the width, length (depth) and height may be measured during the packaging process by sensors (commodity width detecting sensor, commodity height detecting sensor, and so forth). The moving distance of the affixing unit (X) may be obtained by a formula, and the descent timing of the affixing unit may be obtained by the length (depth) dimension of the tray, and finally the affixing unit may be controlled to move on the basis of those results. Further, the affixing position for the label does not have to be limited to the distance from the end part of the tray to the center of the label, but may also be defined as the distance from the end part of the tray to the outer peripheral edges of the label (the blank portion).

7. From the first embodiment, an example is provided wherein an affixing device attached to a packaging machine affixes linerless labels to the packaged goods wrapped by the packaging machine; however, without being limited to this case, for example, a label affixing device that affixes linerless labels to packaged goods transported on a conveyor while not being attached to a packaging machine function, may also be used in the present invention.

8. From the first embodiment, an example is provided wherein an affixing unit that suctions a dispensed linerless label moves horizontally to a position above the packaged goods, and at the time the packaged goods passes below, the affixing unit descends and affixes a label to the packaged goods. However, without being limited to this case, for example an affixing unit not having a horizontal moving mechanism, waits directly above the location the packaged goods will pass and the position at which a label will be dispensed, and if the length in the printing and dispensing direction of the dispensed linerless label changes, the affixing unit may be controlled to change the time it descends towards the packaged goods.

9. An example from the first embodiment illustrates the case where the timing for affixing a label time T is the delay time from the time (T=0) the commodity detecting sensor 57 detects the packaged goods G' until the time the label suction unit C1 begins descent from its standby position. However, without limiting to this case, for example, the distance from the pusher type ejector 8 which operates at a constant speed begins operation, until a position where the leading end of the tray having a known length (depth) is positioned directly beneath the affixing unit on the ejection path (heat seal unit) 10, is calculated, and given that Y0 of the affixing position of the label can be retrieved in step S3 of the processes described in FIG. 10, the timing of the descent of the label suction unit C1 may be calculated on the basis of the aforementioned distance and Y0.

10. An example from the first embodiment illustrates the case where, in order to affix a label to the article be labeled, an affixing position information is stored; the affixing position information is retrieved and in order to affix the label at the position indicated in the affixing position information, by controlling the movement of the affixing unit, a label may be affixed at the affixing position even if the label length has changed. However, there is no need for limiting to this case. For example, if the affixing position is usually fixed, (for instance, the bottom right corner portion), the width, length (depth) and height of the tray can be detected during the packaging process and therefore, on the basis of the respective length data, and the information that the affixing position must be the bottom right corner, the moving distance of the affixing unit in the X direction and the descent timing for the affixing unit can be calculated, and may be used to control the movement in order to affix the label. In other words, in this case, a file for storing the affixing position information, and a means for retrieving that data become unnecessary.

Further, in the above embodiment is illustrated the case where the movement of the affixing unit is for instance, if the label length is determined to be shorter than a standard label length, made shorter by just the amount the determined label length is shorter. However there is no need to be limited by this example. For instance, when the affixing position is static, a file maybe prepared wherein for each conceivable label length, the moving distance of the affixing unit, and the timing of the descent of the affixing unit may be stored; for each label length obtained, the file may be referenced, thereby obtaining the control information needed for moving the affixing unit, so that the movement of the affixing unit may be controlled. Finally, even in cases where the affixing position is not static, a file is prepared wherein for each affixing position, and for each conceivable label length, the moving distance of the affixing unit and the timing of the descent for the affixing unit is stored and as aforementioned, referencing the file allows control information to be obtained thereby allowing the movement of the affixing unit to be controlled.

11. From the second embodiment, an example is provided wherein a movable blade provided as a label cutter is arranged on the upper side of the label sheet, however without being limited to this example, a label cutter may be provided with the movable blade arranged at the lower surface of the label sheet.

12. From the second embodiment, an example is provided wherein a label suction unit provided as the label affixer is of the push type however, without being limited to this example, the label affixer may be, for instance, a brush on type label affixer.

13. From the second embodiment, an example is provided wherein a label holding body and an air diffuser unit are provided as the structure for a holder (receiver); however without being limited to this example, for instance, a typical holder, having a receiving member that supports the affixing surface of the linerless label dispensed from the label dispensing outlet, may also be used.

In that case, the receiving member may be treated with a separating agent so as not to stick to the affixing surface. Further, a member used as a long and thin label receiving member arranged at the upstream end part of the affixing surface in the linerless label dispensing direction of the linerless label dispensed from label dispensing outlet, may be a roller (or a cylindrical rod) treated with a separating agent or may be holder to which the end part of the label sticks. By structuring the holder (receiver) in this manner, the holder (receiver) is of simple construction and is economical. In this case, the preferable timing for operating the label cutter would be timing (2) or timing (3).

14. From the second embodiment, an example is illustrated wherein the label affixing device is provided with a label holder (receiver); the present invention is not limited to this example and the label affixing device may or may not include a label holder (receiver). In the case the label affixing device does not include a holder, the label suction unit of the label affixer directly suctions the dispensed label. That is the label affixer may use timing (2) or timing (3).

15. The second embodiment illustrates an example wherein under configuration 2 (Timing (1)), the step ST14 (the determination of sensor 80) and then the step ST15 (by operation of the print unit 73 the linerless label sheet L' is printed and dispensed) are executed in that order, however the present invention need not be limited by this example and may be configured so that the step S15 is executed, that is the linerless label sheet L' is printed to by means of the operation of the printer unit 73, after which the step S14 is executed, that is the determination by the sensor 80, and after which step ST16 is executed, that is the driving of the label cutter 69 to cut the linerless label sheet L' and thereby the linerless label L is formed. Namely, the operation sequence for ST14 and ST15 may be reversed.

16. The second embodiment illustrates an example wherein the label affixing device is combined with a packaging device, however the present invention is by no means limited to this example. For instance, a device wherein the commodity being transported by a belt conveyor may be detected, and a printer integrally formed of a label affixing unit and a printing unit (including the label cutter) may affix a label to the surface of the transported commodity on the basis of the timing of the detection. In this case, the label affixer may be any of, an applicator type label affixer which is an applicator (a robot arm) may be provided with a suction unit at the tip end part thereof that suction and affixes a label; or a blow-on type label affixer wherein, a dispensed label may be suctioned (suctioned by the pull of air or vacuumed) by a plurality of intermittent gaps located at the tip end part of a label affixing unit, and on the basis of the timing that the transported commodity is detected by the aforementioned detector, the suctioned label may be blasted by air (blown) onto the surface of the transported commodity to affix a label thereto.

The invention claimed is:

1. A label affixing device comprising:

a label issuer that issues an individual linerless label with printed commodity data corresponding to an article;

the label issuer including a printer that prints commodity data corresponding to an article on a linerless label sheet, a label feeder that feeds the printed linerless label sheet, a label cutter that cuts the individual linerless label with printed commodity data corresponding to an article from the linerless label sheet;

a label applicator that suctions and holds the issued linerless label, moves the held linerless label towards the article, and affixes the linerless label on the article;

an ejector that ejects the article to a position where the linerless label is affixed;

a first conveyor that moves the label applicator in a horizontal direction at a right angle to the ejection direction of the article;

a second conveyor that moves the label applicator in a vertical direction with respect to the article;

a memory storage that stores the commodity data to be printed on the linerless label, print format information including a label issuing direction, and affixing position information that specifies a position on the article to affix the linerless label;

the label issuer prints and issues the linerless label by the commodity data and a format stored in a storage;

a controller programmed to control the ejector to eject the article to have the linerless label affixed thereon, and a movement of the label applicator, wherein the controller is programmed to determine a label length based on an amount of commodity data to be printed and the label issuing direction, to modify the affixing position on the article based on the determined label length and timing of descent of the label applicator, and to control the label applicator to affix the issued linerless label at the modified affixing position of the article ejected from the ejector, wherein the print format information is provided with a permission/prohibition flag to indicate whether a change in a print area of the linerless label is permitted or prohibited based on the amount of commodity data to be printed, and wherein the controller is programmed to determine the label length of the issued linerless label based on the amount of commodity data to be printed and the permission/prohibition flag, and to control the timing of the descent of the label applicator based on the determined label length.

2. The label affixing device of claim 1, further comprising:

a third conveyor that rotates a label suction surface of the label applicator within a horizontal plane parallel to the ejection direction of the article.

* * * * *